US009755291B2

(12) United States Patent
Legay et al.

(10) Patent No.: US 9,755,291 B2
(45) Date of Patent: Sep. 5, 2017

(54) COMPACT BIPOLARIZATION POWER SPLITTER, ARRAY OF A PLURALITY OF SPLITTERS, COMPACT RADIATING ELEMENT AND PLANAR ANTENNA COMPRISING SUCH A SPLITTER

(71) Applicant: THALES, Neuilly-sur-Seine (FR)

(72) Inventors: Herve Legay, Plaisance du Touch (FR); Adrien Cottin, Rennes (FR); Ronan Sauleau, Acigne (FR); Patrick Pottier, Bruze (FR)

(73) Assignee: Thales, Courbevoie (FR)

( * ) Notice: Subject to any disclaimer, the term of this patent is extended or adjusted under 35 U.S.C. 154(b) by 291 days.

(21) Appl. No.: 14/530,707

(22) Filed: Nov. 1, 2014

(65) Prior Publication Data

US 2015/0123863 A1 May 7, 2015

(30) Foreign Application Priority Data

Nov. 4, 2013 (FR) ..... 13 02548

(51) Int. Cl.

| | |
|---|---|
| ***H01P 5/12*** | (2006.01) |
| ***H01Q 21/00*** | (2006.01) |
| ***H01Q 21/24*** | (2006.01) |
| ***H01Q 1/50*** | (2006.01) |
| ***H01Q 13/00*** | (2006.01) |

(52) U.S. Cl.

CPC ..... *H01P 5/12* (2013.01); *H01Q 1/50* (2013.01); *H01Q 13/00* (2013.01); *H01Q 21/0037* (2013.01); *H01Q 21/24* (2013.01)

(58) Field of Classification Search

CPC . H01P 5/12; H01Q 1/50; H01Q 13/00; H01Q 21/0037; H01Q 21/24

USPC ..... 333/125

See application file for complete search history.

(56) References Cited

U.S. PATENT DOCUMENTS 6,087,908 A * 7/2000 Haller ..... H01P 1/161 333/122

2013/0207859 A1 8/2013 Legay et al.

FOREIGN PATENT DOCUMENTS

| | | | |
|---|---|---|---|
| EP | 1930982 | A1 | 2/2007 |
| FR | 2959611 | A1 | 4/2011 |
| WO | 2008147132 | A1 | 12/2008 |
| WO | 2009031794 | A1 | 3/2009 |

* cited by examiner

*Primary Examiner* — Robert Pascal
*Assistant Examiner* — Kimberly Glenn
(74) *Attorney, Agent, or Firm* — Baker Hostetler LLP

(57) ABSTRACT

A compact dual-polarization planar power splitter comprises at least four asymmetric orthomode transducers (OMTs) connected in an array suitable for being coupled in-phase to a dual orthogonal polarization feed source via two power distributors mounted perpendicularly in relation to one another, each power distributor comprising at least two lateral metal waveguides disposed parallel to one another, and a transverse metal waveguide coupled perpendicularly to the two lateral metal waveguides and four ends of the lateral waveguides coupled respectively to the four asymmetric OMTs.

33 Claims, 16 Drawing Sheets

COMPACT BIPOLARIZATION POWER SPLITTER, ARRAY OF A PLURALITY OF SPLITTERS, COMPACT RADIATING ELEMENT AND PLANAR ANTENNA COMPRISING SUCH A SPLITTER

CROSS-REFERENCE TO RELATED APPLICATION

This application claims priority to foreign French patent application No. FR 1302548, filed on Nov. 4, 2013, the disclosure of which is incorporated by reference in its entirety.

FIELD OF THE INVENTION

The present invention relates to a compact bipolarization planar power splitter, an array of a plurality of splitters, a compact radiating element and a planar antenna comprising such a splitter. It applies to the field of multibeam focal plane array antennas operating in low frequency bands and, more particularly, to the field of telecommunications in the C-band, L-band and S-band. It also applies to the radiating elements for array antennas, notably in the X-band or Ka-band, and also for a global-coverage space antenna, notably in the C-band.

BACKGROUND

For these different applications, the radiating elements must be able to be excited in a compact manner in single or in dual polarization, to operate for high RF powers, and to have a bandwidth compatible with the intended application. Furthermore, the radiating elements used in the multibeam focal plane array antennas operating in low frequency bands must have a high surface efficiency, a small size, and a low weight. The radiating elements for array antennas have an integration objective which requires the provision of a very compact splitter.

For high-power, low-frequency applications, the radiating elements used are generally metal horns. However, these horns are very bulky and have a substantial weight.

An alternative solution to the metal horn is described in document FR 2959611. This solution relates to a compact radiating element made up of a stack of two Fabry-Perot cavities, which reduces the height of the radiating element by 50% compared with a compact metal horn. However, this radiating element is limited to an aperture diameter of less than 2.5λ, where λ represents the central wavelength, in a vacuum, of the frequency band used.

Planar antennas comprising micro-strip radiating elements enable effective distribution of the RF signals over a radiating aperture. Through the association of metal cavities, a stack made up of a spacer and a thin dielectric substrate, and micro-strip circuits, it is possible to obtain low-loss planar elements. However, these antennas are limited in power.

Planar antennas with apertures greater than 10λ generally comprise a splitter in waveguide technology to route the RF signal over great lengths and a splitter in micro-strip technology to distribute the RF signal locally to radiating elements. The RF signals are divided within the splitter in waveguide technology, and the power at the output of this splitter is often reduced, thus enabling finalization of the distribution of the signal to the radiating elements by a splitter in micro-strip technology. However, when the radiating surface is very small, for example in the region of several wavelengths, this hybridization of the waveguide and micro-strip technologies may not be possible. In fact, the first splitter in waveguide technology is too large and does not allow the distribution of the radiating energy over a very small surface.

SUMMARY OF THE INVENTION

The aim of the invention is to resolve the problems of the existing solutions and to propose an alternative solution to the existing radiating elements, having a medium-size radiating aperture diameter of between 2.5λ and 5λ, comprising a high surface efficiency, low losses and being compatible with high-power applications.

To do this, the invention consists in segmenting a radiating aperture into a plurality of parts, each part, the size of which varies between 1.5λ and 2.5λ, comprising a planar radiating element of a known type, then in disposing the radiating elements in an array by using a new compact planar power splitter operating in bipolarization.

For this purpose, the invention relates to a compact bipolarization planar power splitter comprising at least four transducers intended to be coupled in-phase to a dual orthogonal polarization feed source and two power distributors respectively dedicated to each polarization, the four transducers being connected in an array via the two power distributors, the two power distributors being mounted parallel to a plane XY and oriented perpendicularly in relation to one another. Each transducer is an asymmetric orthomode transducer OMT comprising two access ports located in the plane XY and oriented orthogonally to one another, and a radiating aperture opening out perpendicularly to the plane XY, each power distributor comprising at least two lateral branches disposed parallel to one another, a transverse branch coupled perpendicularly to the two lateral branches and four ends of the lateral branches coupled respectively in the plane XY to the respective access ports of the four asymmetric OMTs, each lateral and transverse branch consisting in metal waveguides, the transverse branch of each distributor being coupled to a feed port intended to be connected to the feed source.

According to one embodiment of the invention, each waveguide of the splitter comprises a rectangular section delimited by four peripheral walls opposed in pairs of different widths, and the waveguides of the transverse branches and of the lateral branches are mounted flat on one of their wider peripheral walls parallel to the plane XY.

According to a different embodiment of the invention, each waveguide of the splitter comprises a rectangular section delimited by four peripheral walls opposed in pairs of different widths, the waveguides of the transverse branches are mounted on one of their narrower peripheral walls in such a way that their wider peripheral walls are perpendicular to the plane XY, and the waveguides of the lateral branches are mounted flat with their two wider peripheral walls parallel to the plane XY.

According to a different embodiment of the invention, each waveguide of the splitter comprises a rectangular section delimited by four peripheral walls opposed in pairs of different widths, the waveguides of the transverse branches and the waveguides of the lateral branches are mounted on one of their narrower peripheral walls in such a way that their wider peripheral walls are perpendicular to the plane XY.

Each feed port may advantageously comprise a coupling slot disposed in a wall of the waveguides of the transverse branches of the two distributors.

Alternatively, each feed port may be an access port of a fifth symmetric or asymmetric OMT disposed in an overlap area of the transverse branches of the power splitter.

The two power distributors can advantageously be disposed parallel to the plane XY and their transverse branches can intersect in an overlap area and can be coupled to one another by a T-coupler.

Alternatively, the two power distributors can be disposed parallel to the plane XY and their transverse branches can be superimposed on one another in an overlap area and can be coupled to one another by a T-coupler in a plane E.

The waveguides of the two transverse branches can advantageously have a reduced thickness P in the overlap area.

According to one embodiment, the two lateral branches and the four transverse branches of the two power distributors can be mounted on two different, respectively lower and upper, planes parallel to the plane XY, and can be coupled to one another by T-couplers in the plane E via coupling slots disposed in an upper wall of the waveguides of the transverse branches and corresponding coupling slots disposed in a lower wall of the waveguides of the lateral branches.

According to one embodiment, the waveguide of each transverse branch can be made up of two waveguide sections located on either side of a central aperture and offset linearly in relation to one another in a direction perpendicular to the corresponding transverse branch, and the coupling slots disposed in the upper wall of the waveguide of each transverse branch can be aligned and disposed on two opposite edges of said upper wall, the two transverse branches then having a rotational symmetry around a central axis of the power splitter.

According to one embodiment, the two power distributors can be disposed in the same plane H parallel to the plane XY, their transverse branches can intersect in an overlap area and can be coupled to one another by a T-coupler in a plane H, and the waveguides of the transverse branches can be coupled to the waveguides of the lateral branches by T-couplers in the plane E.

Advantageously, according to one embodiment, in the T-couplers in the plane E, the waveguides of the transverse branches can be embedded in the corresponding waveguides of the lateral branches.

Advantageously, according to one embodiment, the two power distributors can comprise two independent transverse branches superimposed one above the other, one of the narrower walls of the waveguide of each transverse branch comprising a respective notch, the two respective notches of the two distributors abutting one another.

According to one embodiment, the four ends of the two lateral branches of the two distributors can be curved and folded over the upper wall of the corresponding lateral guides and can be coupled respectively to the access ports of the four asymmetric OMTs by the outside of the power splitter, the two distributors being superimposed one above the other and oriented perpendicularly in relation to one another.

According to one embodiment, the two transverse branches of the two distributors can be mounted in two different planes parallel to the plane XY and located on either side of the plane XY in which the lateral branches of the two distributors are disposed and coupled to the lateral branches of the corresponding distributor by a T-coupler in the plane E.

The invention also relates to an array of a plurality of power splitters comprising an upper level comprising four identical power splitters coupled in an array, and a lower level comprising a fifth power splitter, the fifth power splitter of the lower level comprising a feed port disposed in a central area which feeds in-phase the four power splitters of the upper level.

The invention also relates to a compact radiating element comprising a power splitter and at least four elementary radiating sources connected in an array by the power splitter, each elementary radiating source having an access port coupled respectively to the radiating aperture of a respective asymmetric OMTs of the power splitter.

The compact radiating element can advantageously comprise five elementary radiating sources connected in an array by the power splitter, the fifth elementary radiating source being disposed in an aperture disposed in an upper wall of the waveguides, in the elongation of the feed ports of the splitter, and being intended to be connected directly to the feed source of the splitter.

Each elementary radiating source can advantageously comprise two, respectively lower and upper, concentric and stacked Fabry-Perot cavities.

Each, respectively lower and upper, Fabry-Perot cavity can advantageously have a square-shaped transverse section.

The upper cavities of all the elementary radiating sources connected in an array by the power splitter can advantageously be combined to form a single cavity common to all the elementary radiating sources.

According to one embodiment, the compact radiating element can comprise an array of a plurality of power splitters and at least 16 radiating sources coupled to the splitter array.

Finally, the invention relates to a planar antenna, comprising at least one compact radiating element including a power splitter.

BRIEF DESCRIPTION OF THE DRAWINGS

Other characteristics and advantages of the invention will be clearly explained in the description which follows, given as a purely illustrative and non-limiting example, with reference to the attached schematic drawings, in which.

DETAILED DESCRIPTION

Figure 1A:
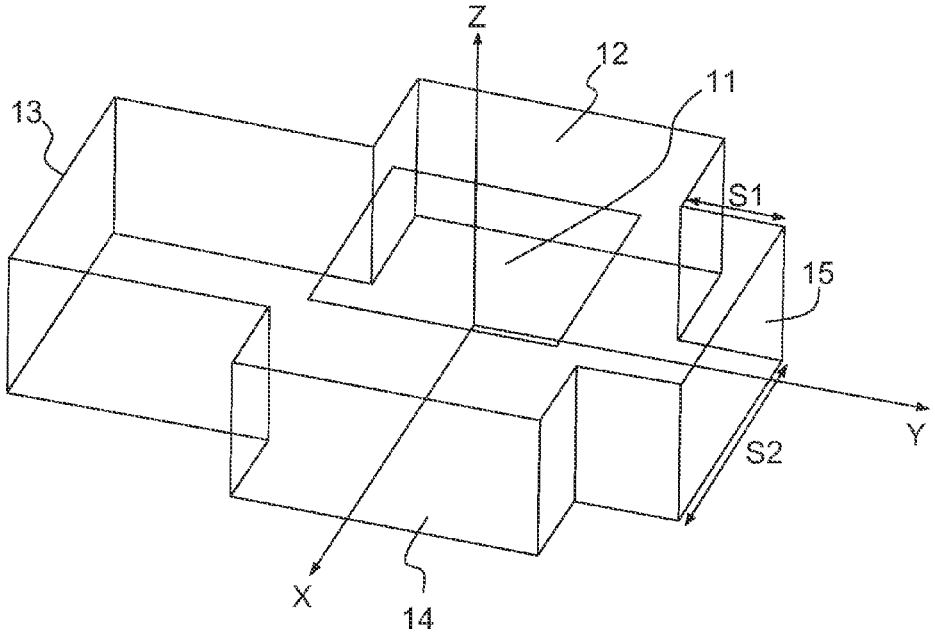
FIG. 1*a* shows a perspective diagram of a first example of an asymmetric OMT, being able to be used in a compact splitter, according to the invention.

According to the invention, the compact bipolarization planar power splitter comprises at least four asymmetric orthomode transducers OMT 10 connected in an array and intended to be coupled in-phase to a feed source operating in two orthogonal polarizations via two power distributors 16, 17 mounted parallel to the same plane XY and oriented perpendicularly in relation to one another. Each asymmetric OMT 10 comprises two access ports 12, 13 located in the same plane XY and oriented orthogonally to one another and a radiating aperture 11 opening out perpendicularly to the plane XY. The two access ports are intended to be fed by two orthogonal polarizations. The two distributors are advantageously identical. Each power distributor 16, 17 comprises at least two lateral branches 16*a*, 16*b*, 17*a*, 17*b* disposed parallel to one another and a transverse branch 16*c*, 17*c* coupled perpendicularly to the two lateral branches. The two power distributors 16, 17 being oriented perpendicularly in relation to one another, the two transverse branches 16*c*, 17*c* of the two distributors 16, 17 are perpendicular to one another and meet in an overlap area 20 in which the two transverse branches can intersect or can be superimposed on one another. The overlap area is thus located in a central area of the power splitter, whereas the four asymmetric OMTs 10 are located in a peripheral area of the power splitter, the two access ports of each asymmetric OMT being coupled respectively in the plane XY to the two distributors. Thus, each asymmetric OMT has its two access ports coupled respectively in the plane XY to an end of a lateral branch of each of the two distributors. All the access ports of the four asymmetric OMTs are therefore located in the plane XY and in the elongation of the respective ends of the lateral branches of the two distributors, which allows a particularly compact planar power splitter to be obtained. The lateral and transverse branches of the two distributors 16, 17 comprise respectively lateral and transverse metal waveguides, for example with a rectangular section, coupled to one another. According to different embodiments of the invention, the metal waveguides can be mounted flat with their wider wall, referred to as the large side of the waveguide, parallel to the plane XY or on their edge, also referred to as the small side of the waveguide, with their wider wall perpendicular to the plane XY. According to the different embodiments of the invention, the coupling between the different waveguides can be implemented by a T-coupler in the plane H or in the plane E.

By definition, a T-coupler is a junction in the shape of a T between an input waveguide provided with an input access and two lateral output waveguides each provided with an output access. A T-coupler in the plane H is a T-coupler in which the two output accesses extend in a plane parallel to the magnetic field H in the input waveguide. A T-coupler in the plane E is a T-coupler for which the two output accesses extend in a plane parallel to the electric field E in the input waveguide. Thus, when the input waveguide is mounted flat, on its wider wall, the two output waveguides of a coupler in the plane H are parallel to the plane XY and the two output waveguides of a coupler in the plane E are perpendicular to the plane XY. Conversely, when the input waveguide is mounted on the edge, i.e. on its narrower wall, the two output waveguides of a coupler in the plane E are parallel to the plane XY.

The four ends of the two lateral branches 16*a*, 16*b*, 17*a*, 17*b* of each distributor make up four access ports of the corresponding distributor. The four access ports of each distributor are coupled respectively to a first access port 12, respectively to a second access port 13, of the four asymmetric OMTs 10. The four asymmetric OMTs 10 connected in an array are thus disposed on the four corners of a square or rectangular planar mesh delimited by the four lateral branches of the two distributors and each comprise two access ports 12, 13 oriented perpendicularly to one another, connected respectively to the two distributors 16, 17 and intended to be fed respectively by two orthogonal polarizations. The polarizations may be linear or circular. Each distributor of the power splitter comprises an input excitation port intended to be connected to the feed source and coupled to the transverse branches 16*c*, 17*c* of each distributor 16, 17, for example in the overlap area. This input excitation port may comprise a coupling slot 21, 22 respectively connected to a feed port 1, 2, the feed port being able to be an access port of a symmetric or asymmetric OMT disposed in the overlap area 20 of the power splitter.

Figure 1B:
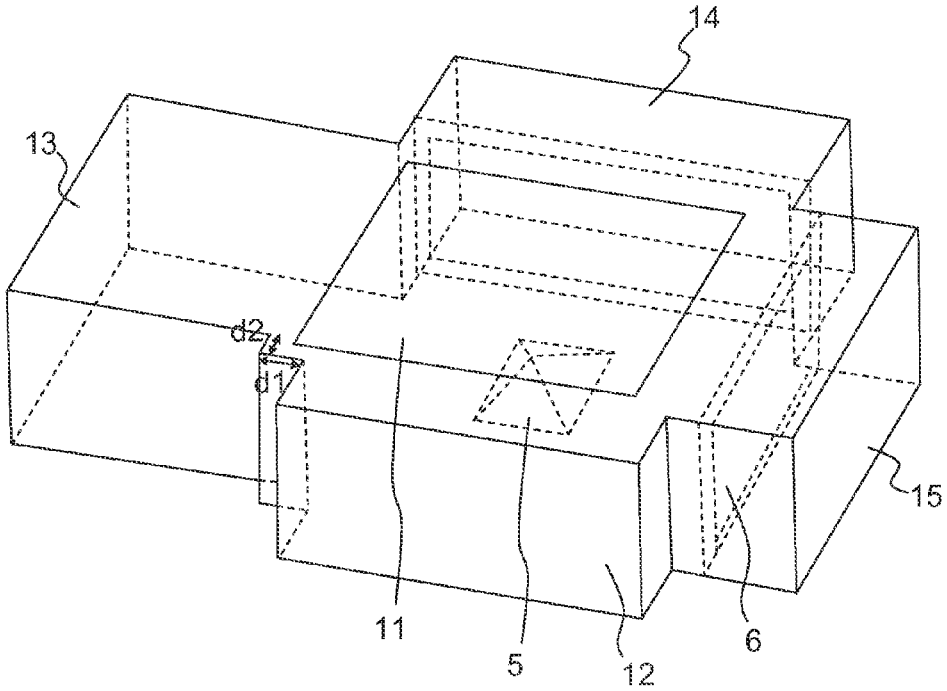
FIG. 1*b* shows a perspective diagram of a second example of an asymmetric OMT, being able to be used in a compact splitter, according to the invention.

FIGS. 1*a* and 1*b* represent two example embodiments of a compact asymmetric OMT according to the invention. The asymmetric OMT 10 comprises a cross-junction comprising four ports diametrically opposed in pairs located in the same plane XY and a radiating aperture 11 placed above the cross-junction, perpendicularly to the plane XY. Two first ports of the cross-junction are connected to short-circuited stubs 14, 15. Two second ports 12 and 13 opposite each stub 14, 15 are access ports operating according to two orthogonal polarizations. The length S1 of each stub 14, 15 is adjusted to reflect the waves in phase opposition in relation to the incident waves which feed the opposite access port 12, 13. The two access ports 12 and 13 couple respectively two orthogonal polarizations towards the radiating aperture 11. In order to minimize the coupling between the two access ports 12 and 13 over a predetermined frequency band, the width S2 of the stubs 14, 15 can be adjusted in such a way that the impedance reduced by the stub in the aperture and combined with that of one or more irises 6 has a value close to the characteristic impedance of a fed access. As shown in FIG. 1*b*, a metal pyramid 5 can also be inserted on the lower plane of the OMT to facilitate the coupling towards the radiating aperture 11. Furthermore, as shown in FIG. 1*b*, the radiating aperture 11 can be offset in relation to the center and according to two directions parallel to the axes of symmetry of the cross-junction respectively by a distance d1, d2, in order to compensate for the asymmetry of the access ports 12, 13. It is thus possible to implement a 20 dB decoupling between the two access ports 12 and 13 over a bandwidth of 10% in relation to the central operating frequency of the OMT.

Figure 1C:
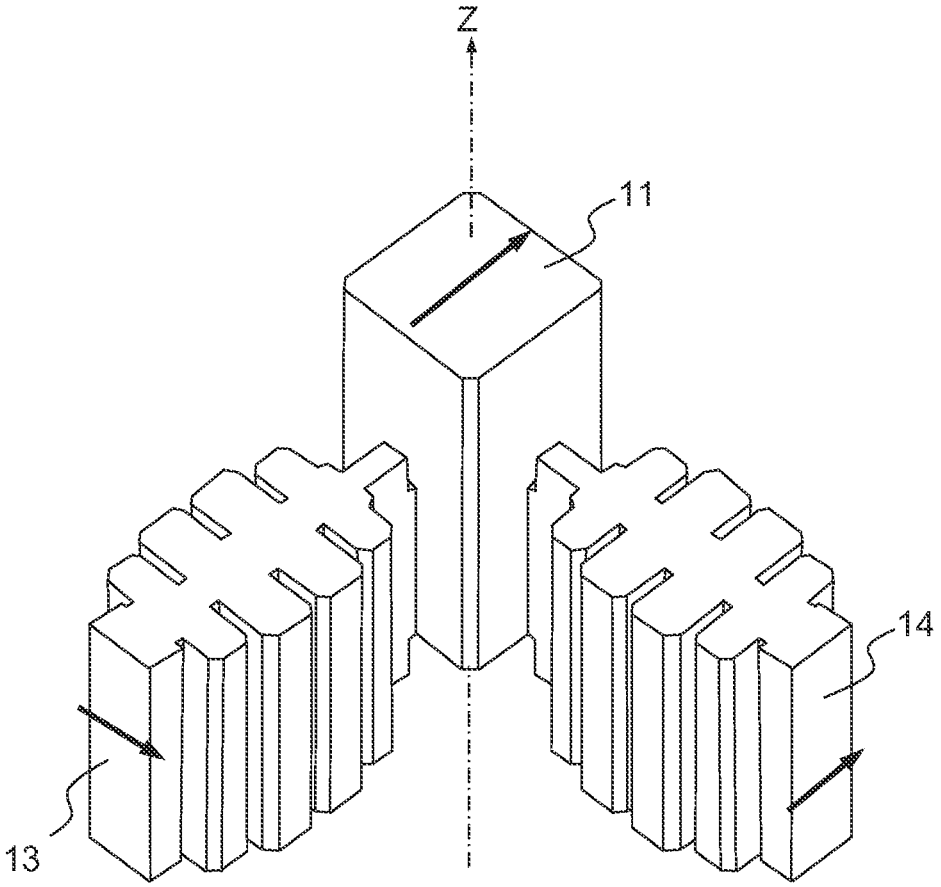
FIG. 1*c* shows a perspective diagram of a third example of an asymmetric OMT, being able to be used in a compact splitter, according to the invention.

FIG. 1*c* shows a third example of a compact asymmetric OMT according to the invention. Unlike the two examples of asymmetric OMTs shown in FIGS. 1*a* and 1*b*, according to this third example, the asymmetric OMT comprises a main waveguide having a longitudinal axis parallel to the axis Z and two transverse branches orthogonal to one another and coupled to the main waveguide via coupling slots. The coupling slots are disposed in the walls of the main waveguide in such a way as to be oriented parallel to the longitudinal axis. The main waveguide comprises an end provided with a radiating aperture 11 intended to be connected to a radiating source such as a horn or a Fabry-Perot cavity source, and the two transverse branches make up two orthogonal access ports 12, 13 of the OMT to which the waveguides of the lateral branches 16*a*, 16*b*, 17*a*, 17*b* of the power splitter according to the invention can be connected. However, the coupling slots being oriented parallel to the axis Z, the transverse branches of the OMT and the access ports of the OMT are also oriented parallel to the axis Z. This orientation of the access ports of the OMT then allows the lateral waveguides of the power splitter to be mounted on their edge, i.e. on one of their narrower peripheral walls, in such a way that their wider peripheral walls are perpendicular to the plane XY.

As described below in relation to FIGS. 11*a* and 11*b*, the four asymmetric OMTs 10 disposed on the four corners of the mesh formed by the four lateral branches of the two distributors to which the four OMTs are coupled can then be associated respectively with four radiating sources coupled respectively to the four radiating apertures 11 of the four asymmetric OMTs 10 in order to feed them in-phase and in dual linear or circular polarization. The assembly then makes up a compact radiating element, the dimension of which can be adjusted according to requirements by adjusting the length of the waveguides of the power splitter. The four radiating sources disposed in an array may be metal horns or stacked Fabry-Perot cavity elements or planar radiating sources if the power delivered by each asymmetric OMT 10 allows it. This enables a wide, high-efficiency, low-loss radiating aperture to be obtained, which is indispensable for maximizing gain and limiting the level of the secondary lobes of the corresponding antenna.

Figure 2:
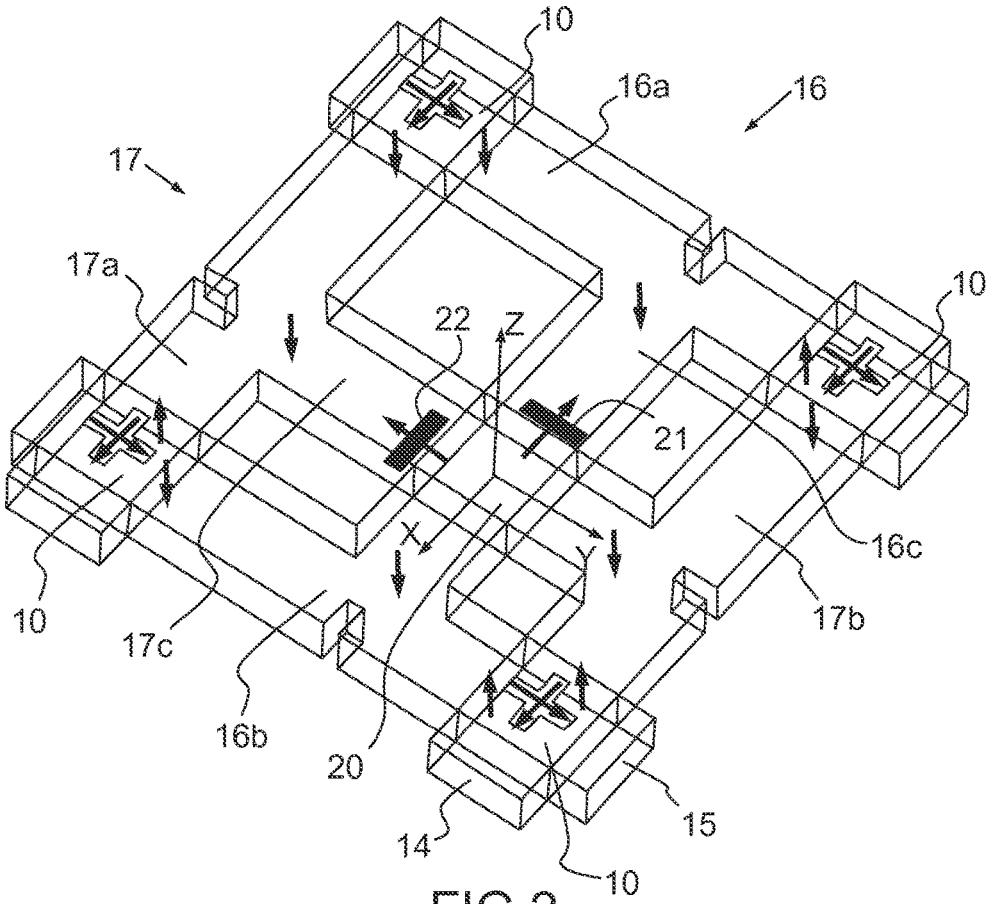
FIG. 2 shows a perspective diagram of a first example of a compact bipolarization planar splitter with a T-coupler in the plane H between the central branch and the transverse branches, in which the transverse branches intersect, according to a first embodiment of the invention.
Figure 3:
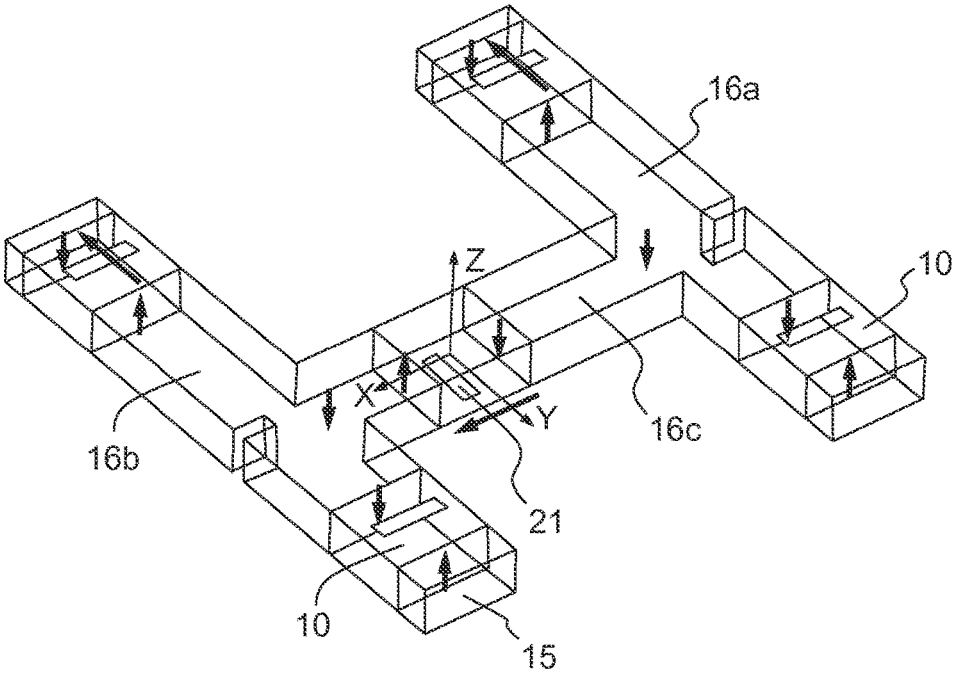
FIG. 3 shows a perspective diagram of an example of a distributor, according to the first embodiment of the invention.

According to a first embodiment of the invention, the two distributors 16, 17 are identical and are mounted perpendicularly in relation to one another in the same plane XY, parallel to the direction of propagation of the waveguides, and their respective transverse branches 16*c*, 17*c* intersect in the overlap area. The lateral and transverse waveguides are all mounted flat with their wider peripheral wall parallel to the plane XY and the connections between each lateral waveguide and the transverse waveguide of the lateral and transverse branches of each distributor are implemented by T-couplers in the plane H. The feed of each distributor 16, 17 can be implemented, for example, by two different feed ports connected to a feed source operating in two orthogonal polarizations, the two feed ports being coupled respectively to the distributor by a respective coupling slot 21, 22, disposed in the wall of the corresponding transverse waveguide 16*c*, 17*c* and parallel to the plane XY. The two coupling slots 21, 22 can be disposed in a lower wall or in an upper wall of the corresponding transverse waveguide 16*c*, 17*c*, as shown in FIG. 2. Alternatively, the feed of each distributor 16, 17 can also be implemented by a symmetric OMT with four access ports placed in the overlap area 20 of the two transverse branches of the two distributors 16, 17. So that the excitation slots of the four asymmetric OMTs 10 corresponding to the same polarizations are excited in-phase and to obtain a coherent excitation of the four radiating sources disposed in an array, not shown in FIG. 2, associated with the four asymmetric OMTs 10, it is necessary, in the case of FIGS. 2 and 3, where the junction between the lateral and transverse branches is implemented by a T-coupler in the plane H, to add a stub, having a length equal to a guided half-wavelength, on one of the sections of each transverse waveguide. By taking account of the additional length provided by the stub, this splitter enables the excitation of the radiating sources separated by around 2λ and therefore the implementation of a radiating element in the order of 4λ. However, this splitter is unsymmetrical, which is detrimental to the performance of the radiating element due to a risk of producing a coupling between the access ports having different polarizations and causing excitations of the cross-polarizations.

Figure 4A:
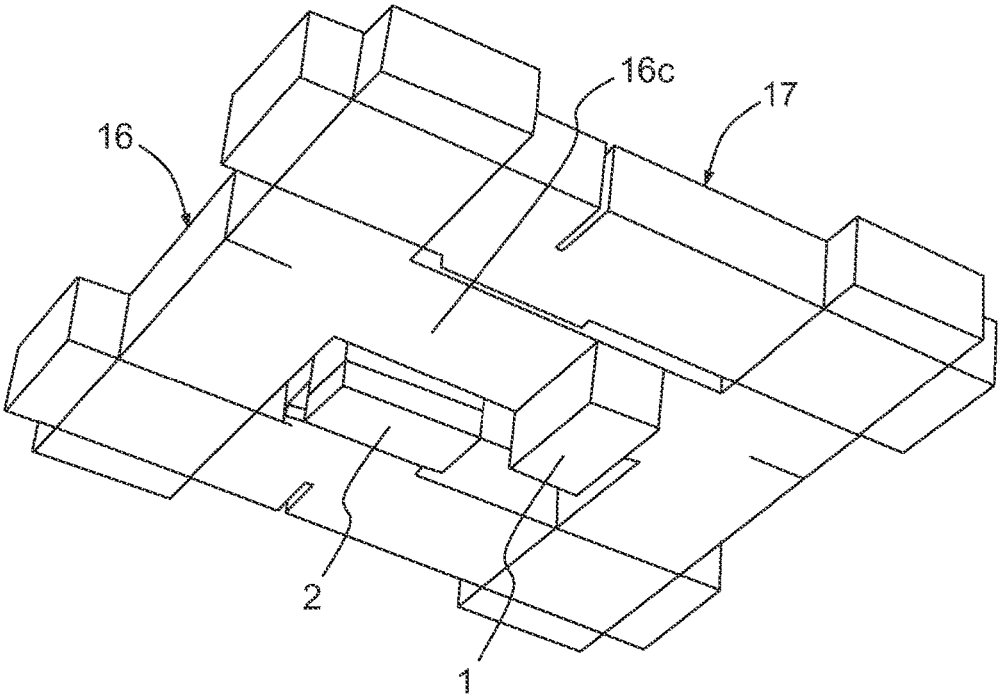
FIGS. 4*a* and 4*b* show a bottom view and a top view of a second example of a compact planar splitter with a T-coupler in the plane H, in which the transverse branches are superimposed on one another, according to a second embodiment of the invention.
Figure 4B:
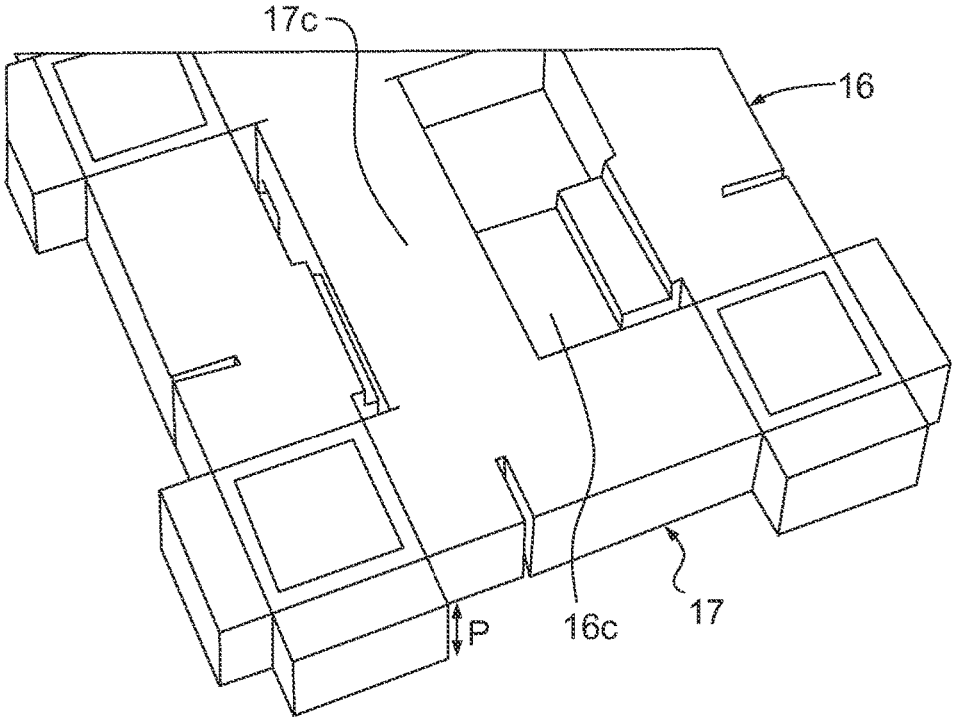

According to a second embodiment of the invention shown in FIGS. 4*a* and 4*b*, the two distributors 16, 17 are mounted perpendicularly in relation to one another in the same plane XY, but, in the overlap area, their respective transverse branches 16*c*, 17*c* are superimposed one above the other. The superimposition can be implemented either by a curving of the transverse branches, or by a progressive reduction in their cross section as shown in FIG. 4*b*. Thus, in the bottom view shown in FIG. 4*a* and the top view shown in FIG. 4*b*, the transverse branch 16*c* of the distributor 16 passes below the transverse branch 17*c* of the distributor 17. The transverse branch 16*c*, 17*c* of each distributor is coupled to a respective input port 1, 2 disposed in the lower wall of each corresponding transverse waveguide 16*c*, 17*c*, the two input ports 1, 2 of the two transverse branches having orthogonal polarizations. The two transverse branches of the two distributors 16, 17 do not therefore intersect, which allows the coupling between the two input ports 1, 2 of the two distributors 16, 17 to be reduced. The connections between each lateral waveguide and the transverse waveguide of the lateral and transverse branches of each distributor are implemented by T-couplers in the plane H. In order to enable the superimposition of the waveguides, the waveguides of the transverse branches 16*c*, 17*c* have a reduced thickness in the overlap area in such a way that the total thickness of the two transverse waveguides in the overlap area corresponds to the normal thickness P of a single waveguide.

According to a third embodiment of the invention, the connections between each lateral branch 16*a*, 16*b*, 17*a*, 17*b* and the transverse branch 16*c*, 17*c* of each distributor 16, 17 are implemented by T-couplers in the plane E. In this case, as shown, for example, in FIGS. 5*a* and 5*b*, the two transverse waveguides 16*c*, 17*c* of the two distributors and the four lateral waveguides 16*a*, 16*b*, 17*a*, 17*b* are mounted on two different tiers parallel to the plane XY. For example, the lower tier may be made up of the two transverse waveguides 16*c*, 17*c* which intersect in the plane H and the upper tier may be made up of the four lateral waveguides 16*a*, 16*b*, 17*a*, 17*b* coupled to the four OMTs 10 mounted on the four corners of the square mesh. In this case, the couplings in the plane E, between each transverse waveguide and the two lateral waveguides of the same distributor are implemented by two respective coupling slots 23*a*, 23*b*, 24*a*, 24*b* disposed in the upper wall, on the two ends of the transverse waveguide, and by two corresponding slots 25*a*, 25*b*, 26*a*, 26*b* disposed in the center of the lower wall of each lateral waveguide of the distributor. The two coupling slots 21, 22 for the feed of each distributor by two orthogonal polarizations are located in the intersection area of the two transverse branches 16*c*, 17*c*, and may be either slots disposed in the lower wall of the transverse waveguides or a fifth asymmetric OMT placed in the intersection area. The couplings between the lateral branches and the transverse branch of each distributor being in the plane E, the two sections of each transverse waveguide placed on either side of the intersection area of the transverse waveguides are fed in-phase. This allows the four asymmetric OMTs 10 to be excited in-phase without the need to add a stub on the transverse branches of the distributors, and improves the compactness of the radiating element obtained. Furthermore, each distributor is then symmetric in relation to the disposition of the four asymmetric OMTs 10, thereby improving the bandwidth of the radiating element obtained. However, in order to excite the lateral waveguides in a symmetric manner, it is necessary for the coupling slots disposed in each lateral waveguide and in each transverse waveguide to be placed in an unsymmetrical manner in relation to the corresponding waveguide. In particular, in FIGS. 5*a* and 5*b*, the coupling slots 23*a*, 23*b*, 24*a*, 24*b* are disposed at the edge of the transverse waveguides and the coupling slots 25*a*, 25*b*, 26*a*, 26*b* are placed at the edge of the lateral waveguides and not in the center. As in the first embodiment of the invention, this therefore results in an unsymmetry of the power splitter, which risks producing couplings between the access ports of the asymmetric OMTs 10 operating in different polarizations and causing an excitation of the cross-polarizations.

Figure 5A:
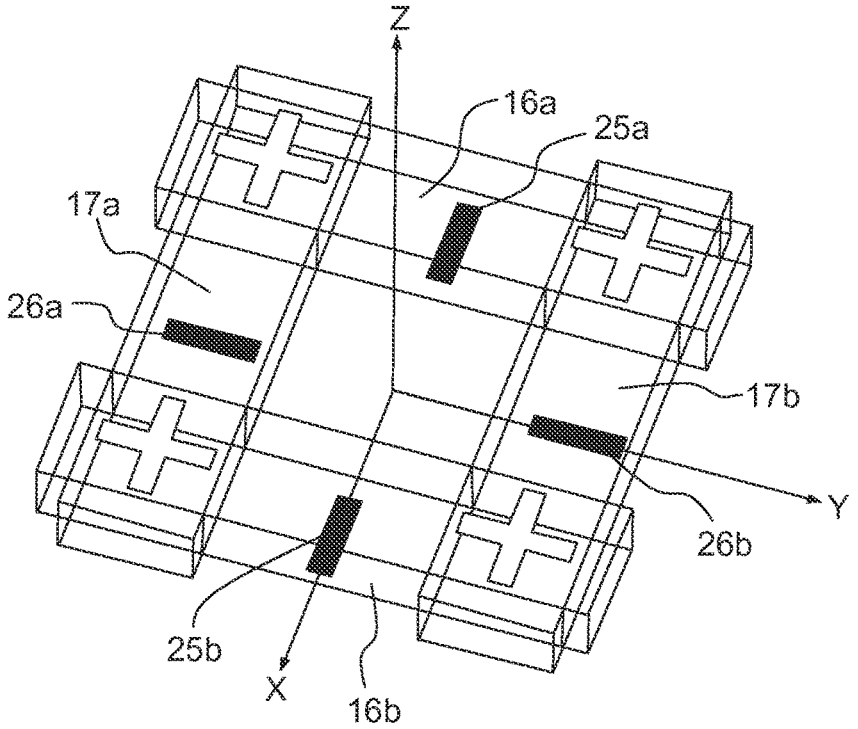
FIGS. 5*a* and 5*b* show two perspective diagrams, illustrating two tiers of a third example of a compact planar splitter with a T-coupler in the plane E between the lateral and transverse branches, according to a third embodiment of the invention.
Figure 5B:
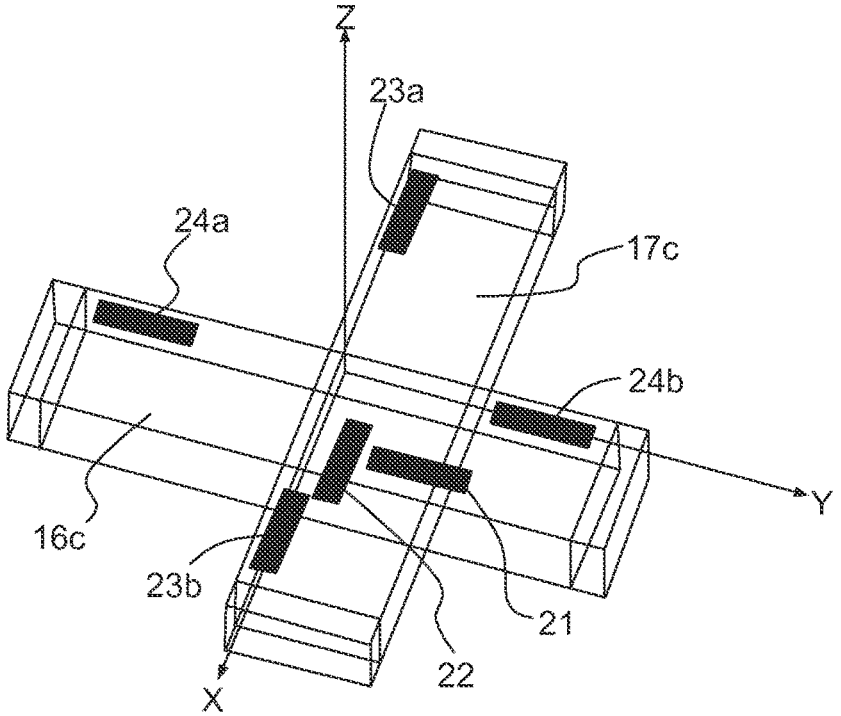
Figure 6A:
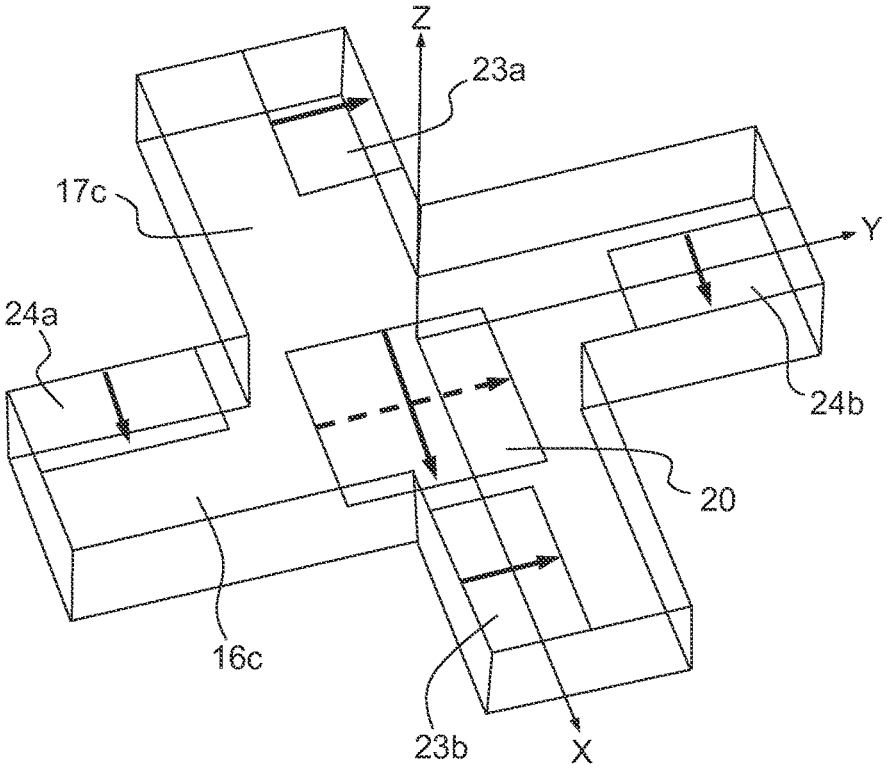
FIGS. 6*a*, 6*b* and 6*c* show three perspective diagrams illustrating respectively a lower plane, two superimposed planes without the asymmetric OMTs, two superimposed planes with the asymmetric OMTs, of a fourth example of a compact planar splitter with a T-coupler in the plane E and rotationally invariant, according to a fourth embodiment of the invention.
Figure 6B:
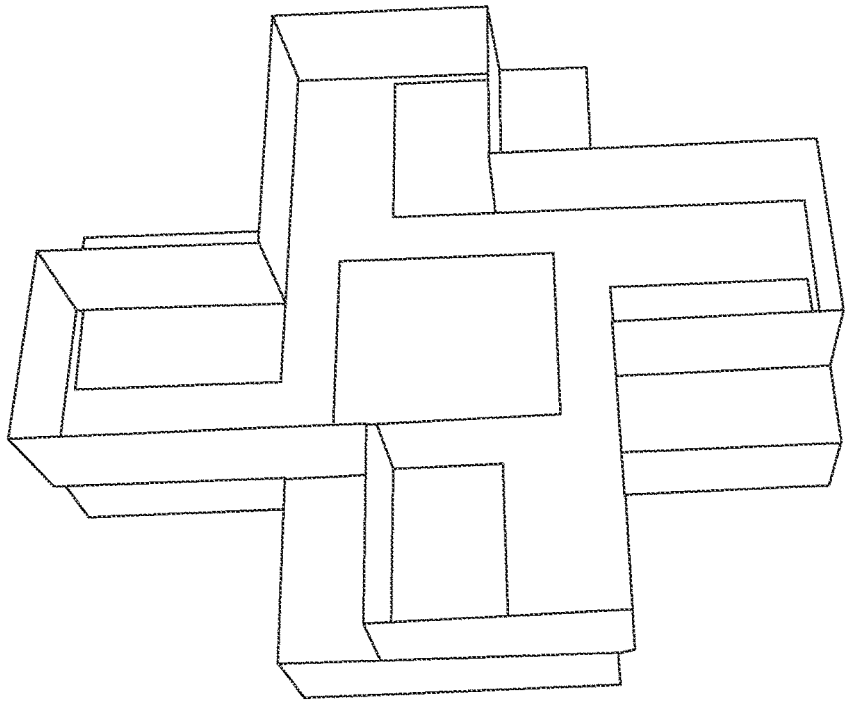
Figure 6C:
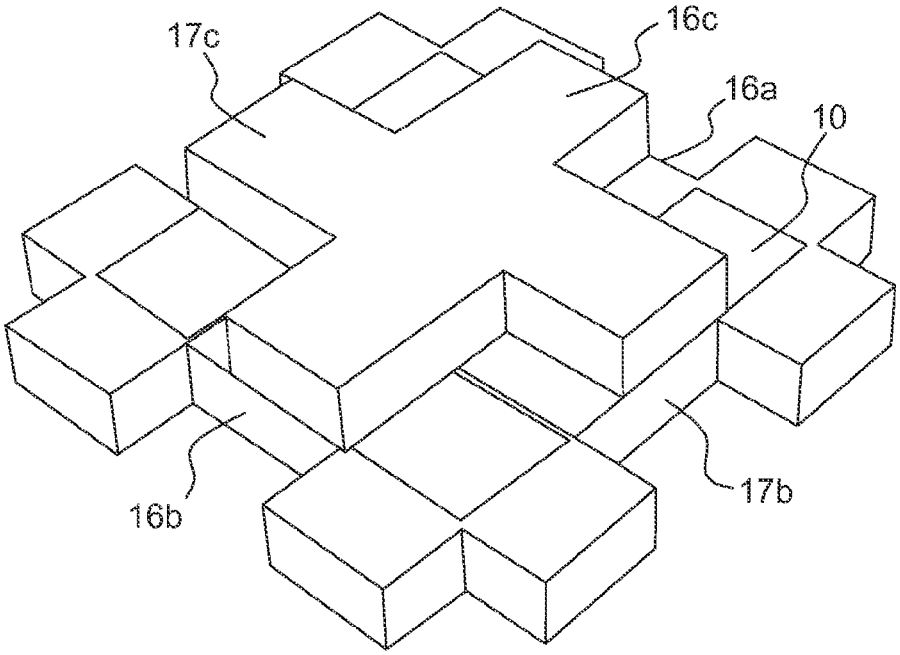

According to a fourth embodiment of the invention shown in FIGS. 6*a*, 6*b*, 6*c*, the connections between each lateral waveguide and the transverse waveguide of each distributor are implemented by T-couplers in the plane E as in FIGS. 5*a* and 5*b*, but the diagram of the lower tier shown in FIG. 6*a* shows that the coupling slots disposed on the two ends of each transverse waveguide are disposed on two opposite edges of the upper wall of the transverse waveguide. The two transverse waveguide sections located on either side of the intersection area where a central aperture 20 intended for the feed of the distributors is located are not aligned but are offset linearly in relation to one another in a direction perpendicular to the corresponding transverse branch in such a way that the coupling slots 23*a*, 23*b* and 24*a*, 24*b* respectively, disposed on the opposite edges of each transverse waveguide, are aligned and disposed symmetrically in relation to the central aperture. FIG. 6*b* is a bottom view showing the configuration of the two lower and upper tiers when they are superimposed one above the other, the asymmetric OMTs 10 being omitted. FIG. 6*c* is a top view of the two superimposed tiers, the asymmetric OMTs 10 being coupled to the four ends of the two distributors. The coupling slots disposed in the transverse and lateral waveguides correspond to one another in pairs. In this configuration, the transverse waveguides then have a rotational symmetry around a central axis of the power splitter. The splitter therefore has a rotationally invariant configuration. This rotational invariance provides this configuration with an excellent decoupling between the orthogonal-polarization access ports in the case where the feed is in circular polarization.

Figure 7A:
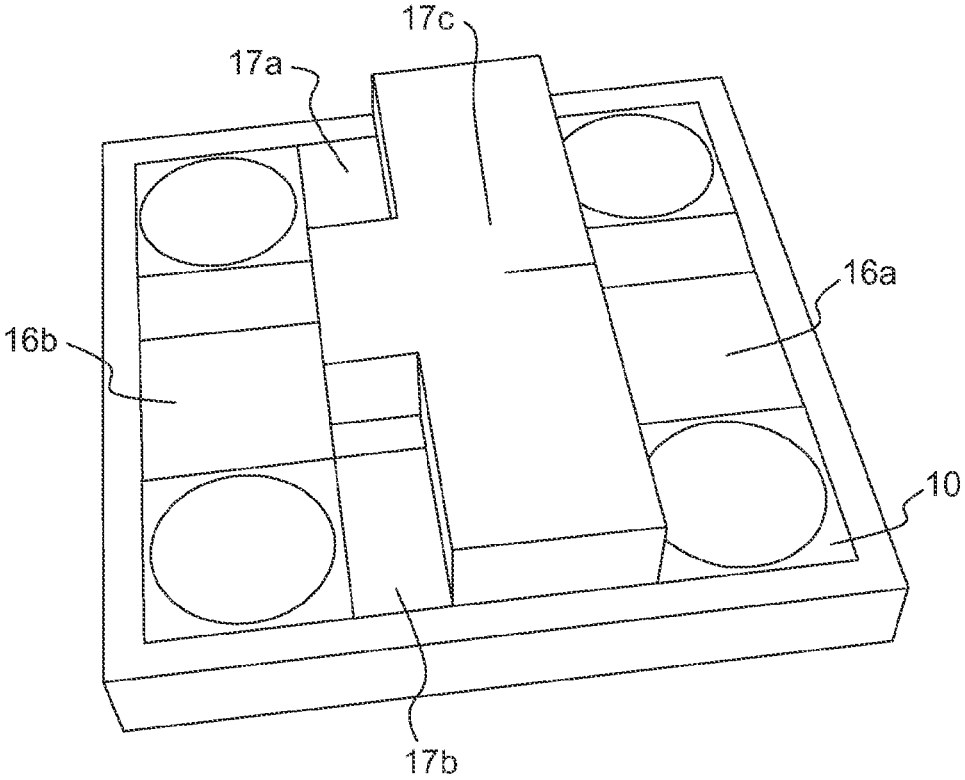
FIGS. 7*a* and 7*b* show a top view and a bottom view illustrating a fifth example of a compact planar splitter with a T-coupler in the plane E between the lateral and transverse branches, the transverse branches of the two distributors being disposed on either side of the plane containing the lateral branches, according to a fifth embodiment of the invention.
Figure 7B:
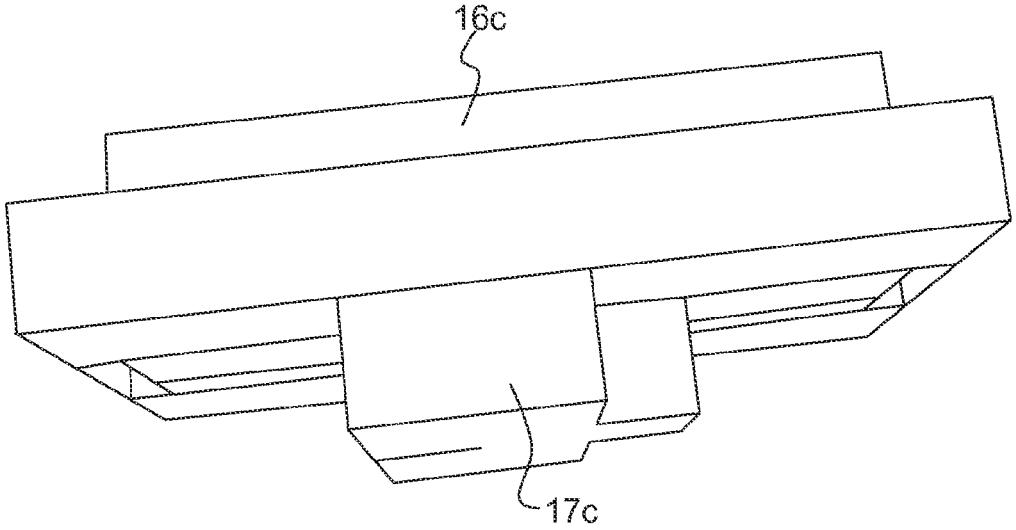
Figure 7C:
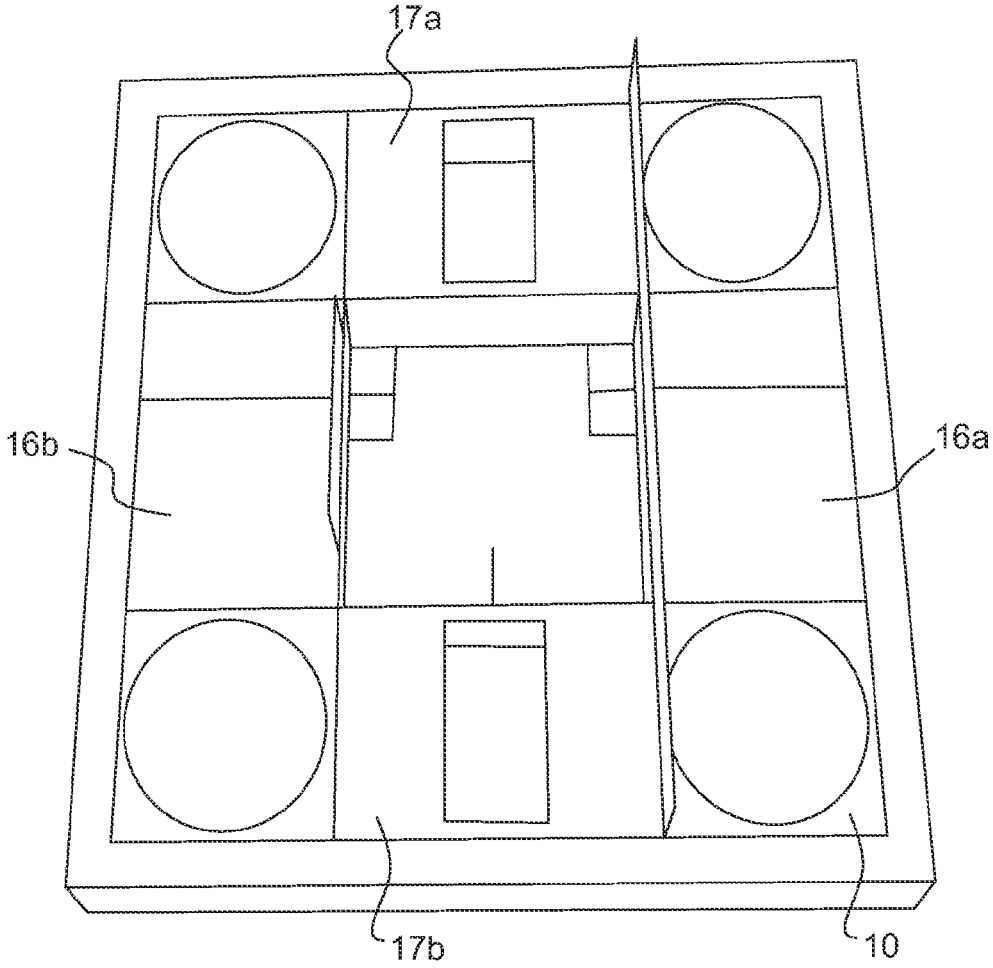
FIGS. 7*c* and 7*d* show a top view of the four lateral branches of the two distributors coupled to the four asymmetric OMTs and respectively a top view of a transverse branch of a distributor, according to the fifth embodiment of the invention.
Figure 7D:
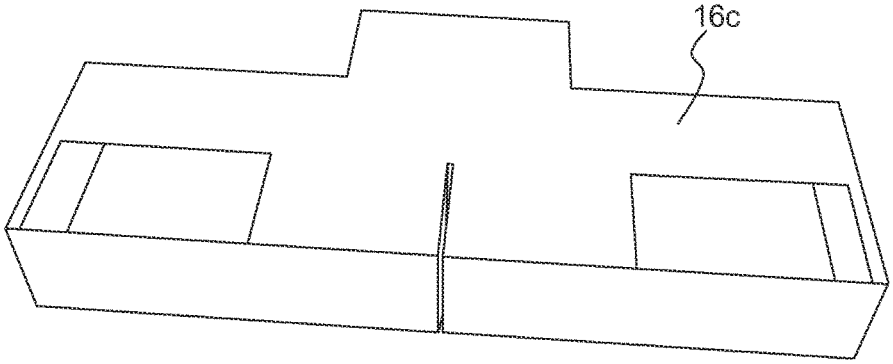

According to a fifth embodiment of the invention shown in the top view in FIG. 7*a* and the bottom view in FIG. 7*b*, the connections between each lateral branch and the transverse branch of each distributor are implemented by T-couplers in the plane E, but the transverse branches of the two distributors are not located in the same plane. The transverse branches 16*c*, 17*c* of the two distributors are disposed on either side of the plane containing the lateral branches 16*a*, 16*b*, 17*a*, 17*b* and are mounted according to two directions perpendicular to one another. The transverse branches 16*c*, 17*c* of the two distributors do not therefore intersect and not superimposed on one another. The splitter therefore comprises three different tiers: lower, central and upper. The upper tier comprises a transverse branch 16*c* of the first distributor coupled in the plane E to the two lateral branches 16*a*, 16*b* of the first distributor by corresponding coupling slots disposed in the transverse branch and in the two lateral branches of the first distributor. Similarly, the lower tier comprises a transverse branch 17*c* of the second distributor coupled in the plane E to the two lateral branches 17*a*, 17*b* of the second distributor by corresponding coupling slots disposed in the transverse branch and in the two lateral branches of the second distributor. The lower tier therefore has a structure identical to the upper tier, but is oriented in a direction perpendicular in relation to the lower tier. The transverse branch 16*c* comprises a feed input port of the first distributor and the transverse branch 17*c* comprises a feed input port of the second distributor. FIG. 7*c* is a top view of the four lateral branches 16*a*, 16*b*, 17*a*, 17*b* of the two distributors coupled to the four asymmetric OMTs 10 showing two coupling slots disposed in two opposite lateral branches 17*a*, 17*b* of the second distributor. FIG. 7*d* is a bottom view of a transverse branch 16*c* of the first distributor showing two coupling slots intended to be disposed facing two corresponding coupling slots disposed in two opposite lateral branches 16*a*, 16*b* of the first distributor.

Figure 8A:
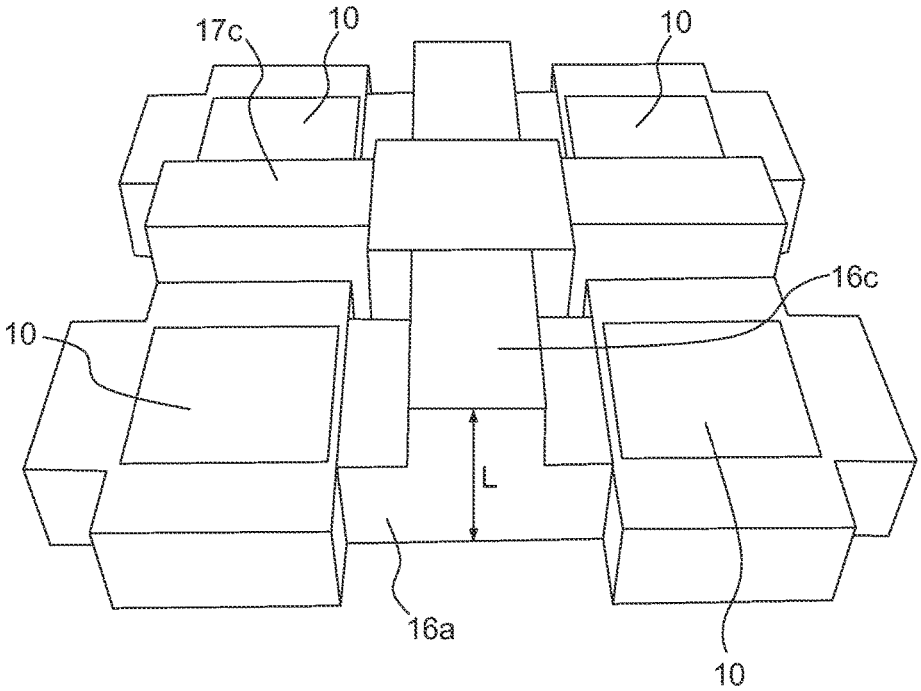
FIG. 8*a* shows a perspective view of a sixth example of a compact planar splitter with a T-coupler in the plane E between the lateral and transverse branches, the waveguides of the transverse branches being mounted on their edge in such a way that their wider surface is perpendicular to the plane XY, according to a sixth embodiment of the invention.
Figure 8B:
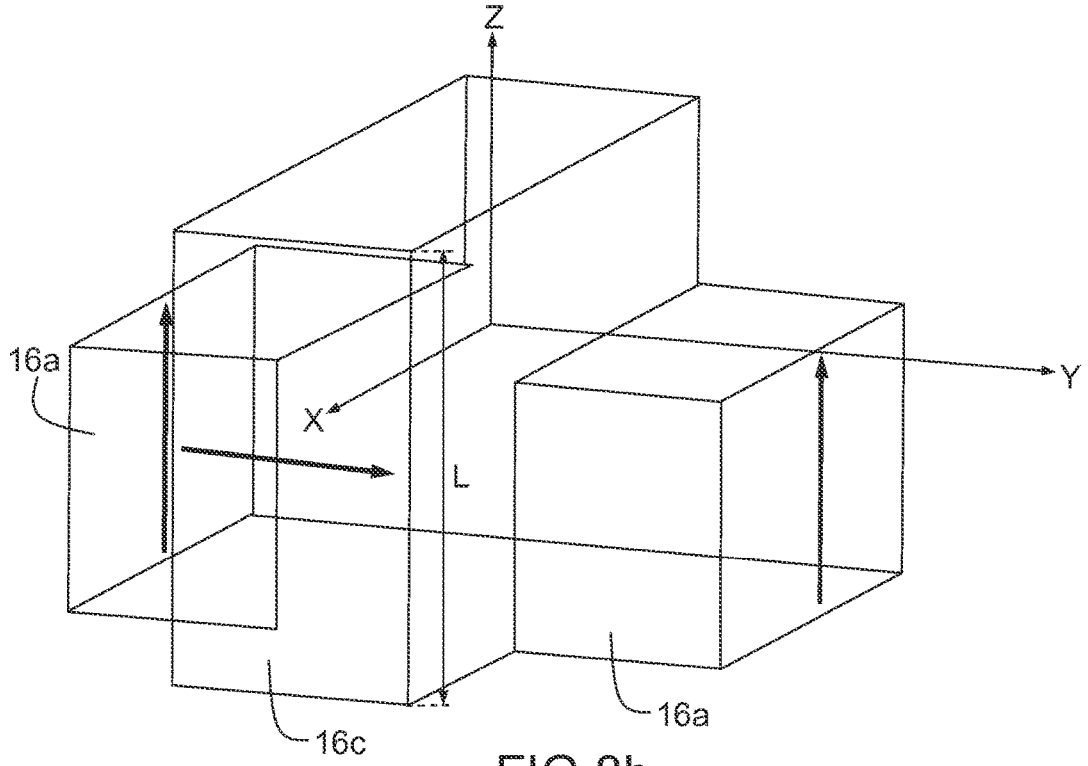
FIG. 8*b* shows a detail view of the junction between the lateral branches and the transverse branch in the T-coupler in the plane E corresponding to the sixth example embodiment shown in FIG. 8*a*, according to the invention.
Figure 8C:
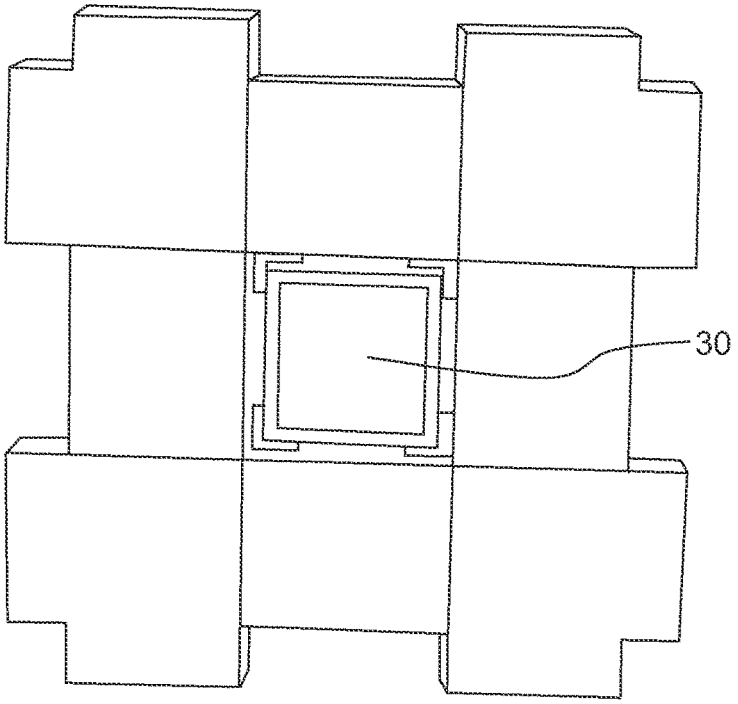
FIGS. 8*c* and 8*d* show two, respectively bottom and side, views of the compact planar splitter, according to the sixth embodiment of the invention.
Figure 8D:
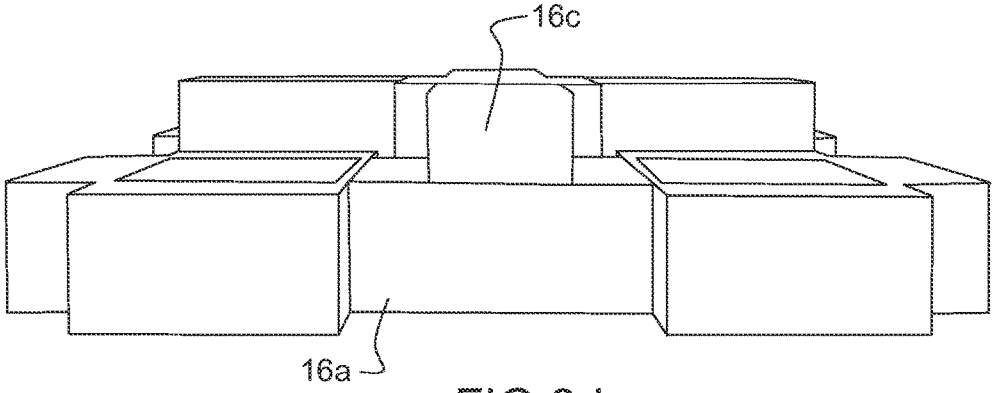
Figure 8E:
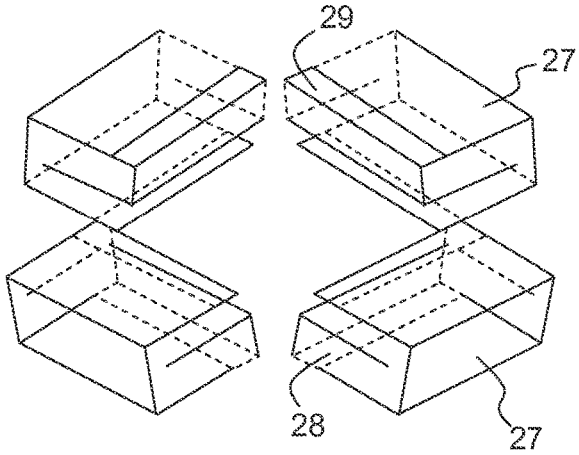
FIG. 8*e* shows an exploded detail view of the waveguide sections intended for the regulation of the phase offset of the feed of the fifth central radiating source, according to the invention.

According to a sixth preferred embodiment of the invention, as shown in FIGS. 8*a*, 8*b*, 8*c* and 8*d*, the waveguides of the transverse branches 16*c*, 17*c* of the compact planar splitter can be mounted on their edge in such a way that their wider wall is perpendicular to the plane XY, whereas the waveguides of the lateral branches 16*a*, 16*b*, 17*a*, 17*b* are mounted flat with their wider wall parallel to the plane XY. At the junction between the transverse and lateral branches, as shown in the detail view in FIG. 8*b*, the waveguides of the transverse branches 16*c*, 17*c* are embedded in the corresponding lateral waveguides 16*a*, 16*b*, 17*a*, 17*b*, thereby limiting the thickness of the splitter to the width L of their wider wall. In this case, the two transverse branches 16*c*, 17*c* intersect in the center of the splitter and the junctions, between the lateral waveguides and the transverse waveguides are couplers in the plane E which do not require any coupling slot at the junction. The waveguides of the lateral and transverse branches intersect and are excited by access ports disposed in the center of the splitter and connected to a feed source operating in two orthogonal polarizations. This planar splitter structure has the advantage of being perfectly symmetrical, simpler to implement and the most compact of all the examples of splitters described above. The central access ports of the planar splitter can be fed by an asymmetric OMT or alternatively by a symmetric OMT. The structure of this sixth example of a splitter being perfectly symmetrical, it is possible to dispose a fifth radiating source, for example with direct radiation, in the center of the splitter, in an aperture 30 disposed in the upper wall of the transverse waveguides 16*c*, 17*c* of the splitter. The fifth radiating source with direct radiation can be situated in the elongation of the central feed access of the planar splitter and may be connected directly to the central feed source of the splitter located in the lower wall of the transverse waveguides of the splitter. The addition of this fifth radiating source enables a better distribution of energy over the entire surface of the radiating aperture implemented by all the radiating sources connected in an array. However, the central feed access may not be in-phase with the four peripheral accesses of the four OMTs 10. In this case, in order to make the central access in-phase with the four peripheral accesses, it may be necessary to add a waveguide section housed in the central aperture 30 of the power splitter, between the central feed access and the fifth radiating source. So that the waveguide section does not significantly increase the thickness of the power splitter, it is possible to implement the phase offset by using four sections of waveguides 27 folded over on themselves and equipped with a lower coupling slot 28 and an upper coupling slot 29, as shown schematically in the exploded view in FIG. 8*e*. To enable a clear understanding, the four waveguide sections are shown distanced from one another, but they are intended to be inserted side-by-side in the central aperture 30 of the power splitter. However, the addition of this fifth radiating source is possible only in the case of a T-coupler in the plane E, the transverse guides of which are mounted on their edge. In the other configurations, this radiating source would not be centered and furthermore, in the configurations which comprise couplers in the plane H, the orthogonal excitation polarizations of this fifth radiating source would not be coherent.

Figure 9A:
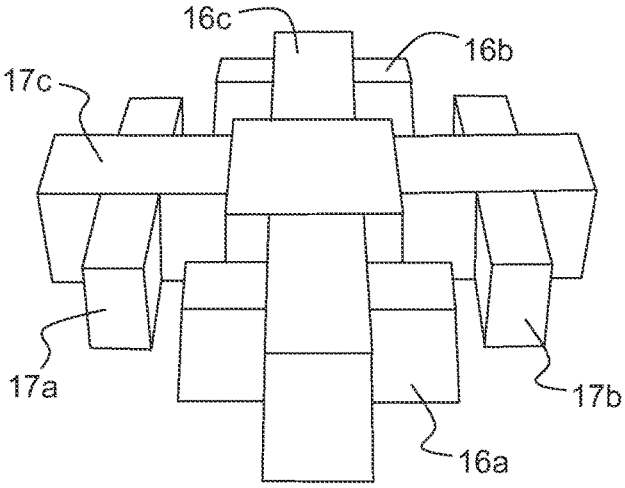
FIG. 9*a* shows a perspective diagram of a seventh example of a compact planar splitter with a T-coupler in the plane E between the lateral and transverse branches, the waveguides of the transverse branches and the waveguides of the lateral branches being mounted on their edge in such a way that their wider surface is perpendicular to the plane XY, the OMTs being omitted, according to a seventh embodiment of the invention.

According to a seventh embodiment of the invention shown in FIG. 9*a*, the lateral waveguides and transverse waveguides of the power splitter are all mounted on their edge, i.e. on one of their narrower peripheral walls, in such a way that their wider peripheral walls are perpendicular to the plane XY. The transverse waveguides are then coupled to the lateral waveguides by T-couplers in the plane E. In this case, the four asymmetric OMTs fed by the power splitter are all consistent with the embodiment described in relation to FIG. 1 *c*. In FIG. 9*a*, the transverse branches 16*c*, 17*c* of the two distributors intersect in the center of the splitter, and the feed ports 1, 2 connected to a feed source operating in two orthogonal polarizations are located in the intersection area. This arrangement is very compact, but, due to the presence of the intersection area, cross-polarization parasitic stationary modes may appear, which reduce the operating band of the splitter.

Figure 9B:
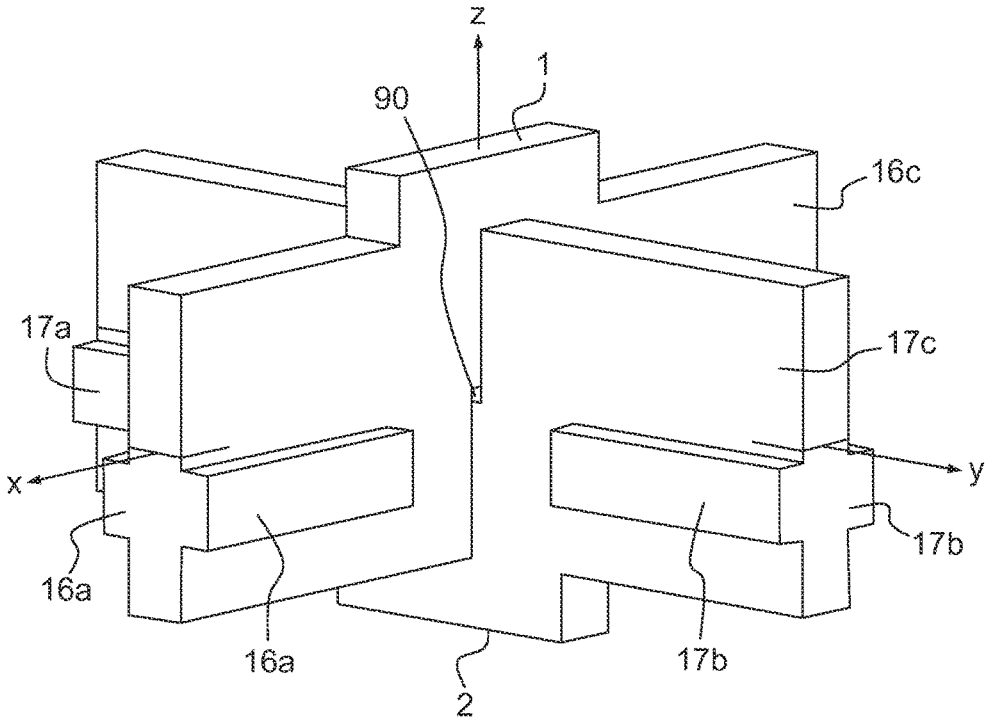
FIG. 9*b* shows a perspective view of an eighth example of a compact planar splitter in which the waveguides of the transverse branches are mounted on the edge, the transverse branches of the two distributors being independent and provided with a respective notch, according to an eighth embodiment of the invention.
Figure 9C:
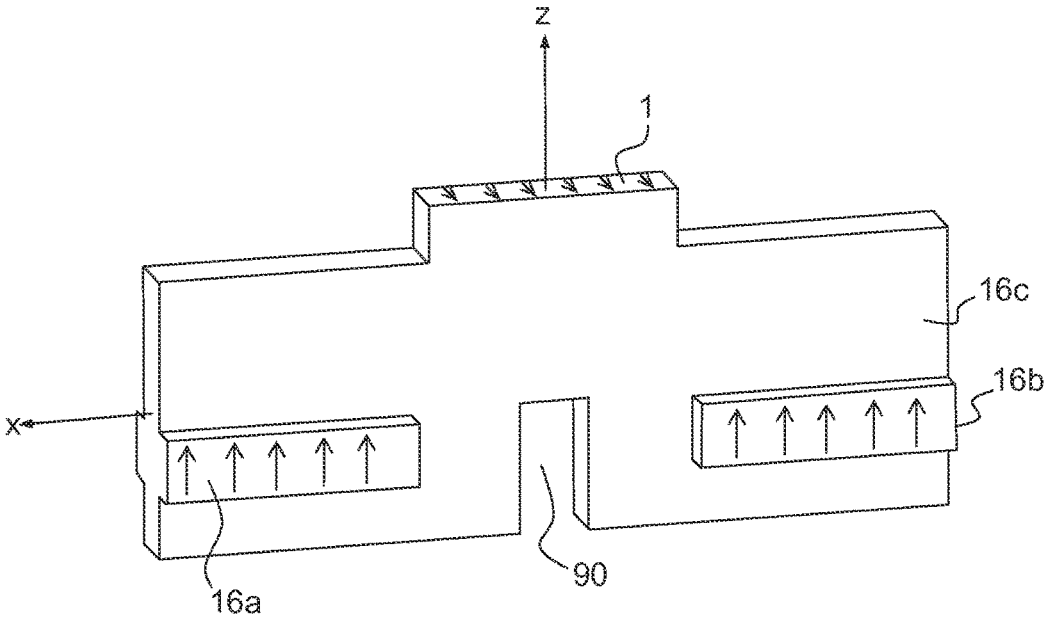
FIG. 9*c* shows a front view of a distributor of the splitter shown in FIG. 9*b;*

According to an eighth embodiment of the invention shown in FIGS. 9*b* and 9*c*, the waveguides of the transverse branches 16*c*, 17*c* of the power splitter are mounted on their edge with their narrower wall parallel to the plane XY, although the transverse branches 16*c*, 17*c* of the two distributors do not intersect, but are independent and superimposed one above the other. The lateral branches 16*a*, 16*b*, 17*a*, 17*b* are mounted flat on their wider wall and are coupled in the plane E to the transverse branches. The transverse branch of each, respectively lower and upper, distributor then comprises a respective feed port, the two feed ports 1, 2 being oriented according to a direction perpendicular to the plane XY and disposed respectively on a lower wall and an upper wall of the distributor. In order to reduce the size of the power splitter in terms of thickness, i.e. in the direction perpendicular to the plane XY, each distributor comprises, in its wall opposite the feed port, a notch 90 with a width at least equal to the width of a small side of the waveguide of a transverse branch and with a height less than or equal to half of the width of a large side of the waveguide of a transverse branch. In these conditions, the transverse branch of the upper distributor is mounted perpendicularly above the transverse branch of the lower distributor, the two respective notches of the two distributors abutting one another. The two transverse branches of the two distributors are then separated and independent from one another, enabling a good isolation between the two polarizations. The splitter obtained in this eighth embodiment does not therefore produce cross-polarization modes.

Figure 10A:
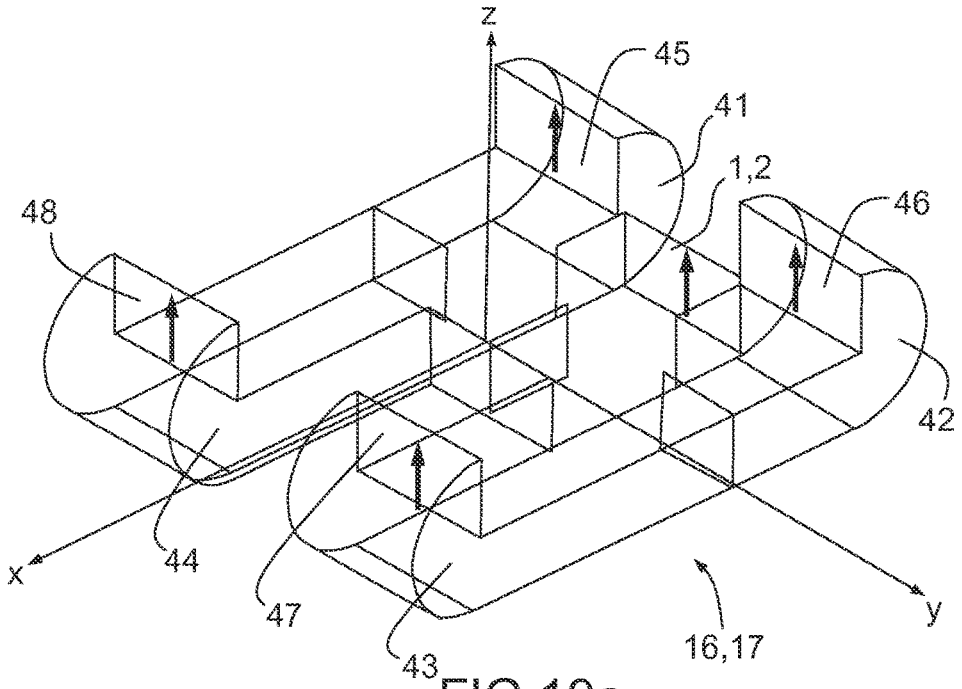
FIGS. 10*a* and 10*b* show a top view of a distributor and respectively of a ninth example of a compact planar splitter with a T-coupler in the plane H, the two distributors being superimposed and comprising curved and folded ends, the asymmetric OMTs being fed by their access ports oriented towards the outside of the splitter, according to a ninth embodiment of the invention.
Figure 10B:
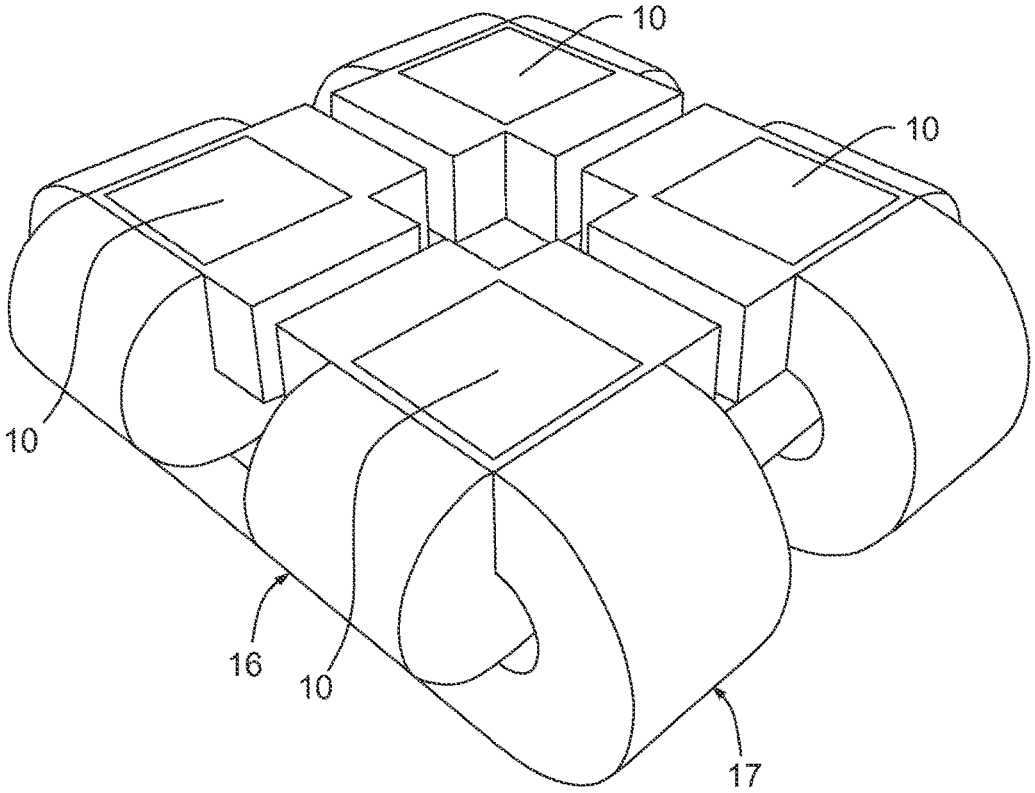

In the first eight embodiments of the invention, the OMTs are fed by their input access ports oriented towards the inside of the splitter. It is also possible to fold the ends of the lateral waveguides of the splitter so that the OMTs are fed by their access ports oriented towards the outside of the splitter, as shown, for example, in FIGS. 10*a* and 10*b* of the ninth embodiment of the invention. In the top view shown in FIG. 10*a*, each distributor 16, 17 is made up of two lateral branches and one transverse branch coupled to the two lateral branches by a T-coupler in the plane H as in FIGS. 2 and 3. Furthermore, the four ends 41, 42, 43, 44 of the lateral waveguides of the two lateral branches of each distributor are curved and folded over the upper wall of the corresponding lateral waveguides in such a way that the output ports 45, 46, 47, 48 of each distributor are placed above said upper wall. Each distributor 16, 17 comprises a feed input port 1, 2 coupled in the plane H to the transverse branch of the distributor. The feed input port 1, 2 being in the plane H, no coupling slot is necessary between the feed input port and the transverse waveguide. As shown in the top view in FIG. 10*b* illustrating the assembled splitter, the two distributors 16, 17 are superimposed one above the other according to the direction Z, on two different tiers, and are oriented perpendicularly in relation to one another. The four output ports of the first distributor 16 and the four output ports of the second distributor 17 are disposed, orthogonally in pairs, on a third tier of the splitter and are coupled respectively by the outside to the corresponding orthogonal input ports of the four asymmetric OMTs 10. In this ninth embodiment, the four asymmetric OMTs are therefore fed by their access ports oriented towards the outside of the splitter, whereas, in all the other embodiments, the four OMTs are fed by their access ports oriented towards the inside of the splitter. The principle consisting in feeding the OMTs by their access ports oriented towards the outside of the splitter, as shown explicitly in FIGS. 10*a* and 10*b* for a splitter of which the configuration comprises a T-coupler in the plane H, can also be applied to a splitter of which the configuration comprises a T-coupler in the plane E.

Figure 11A:
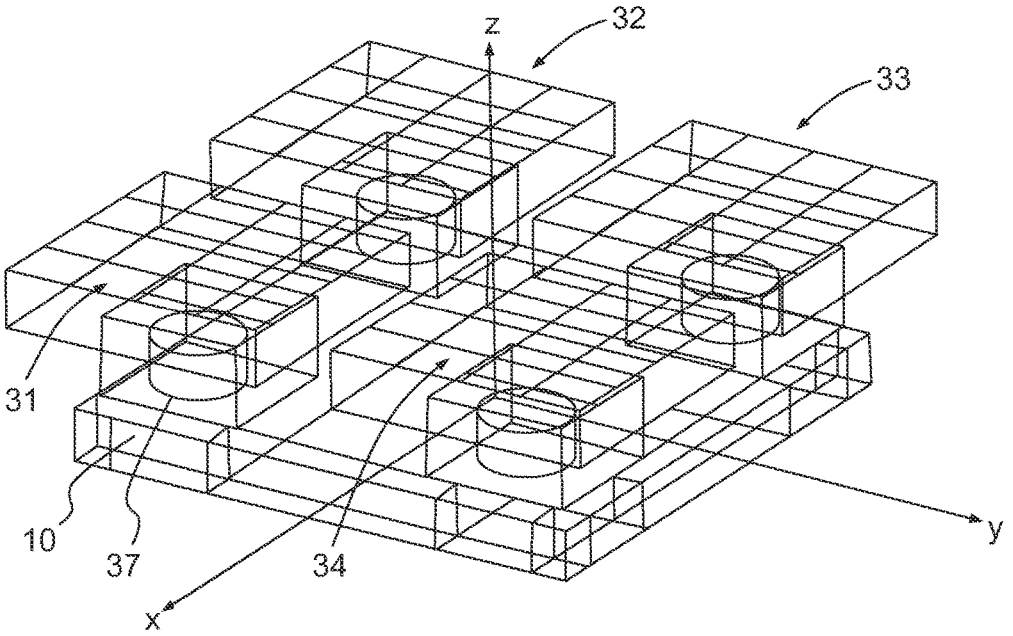
FIGS. 11*a* and 11*b* show two perspective views of two examples of a radiating element comprising a compact splitter according to any embodiment of the invention.
Figure 11B:
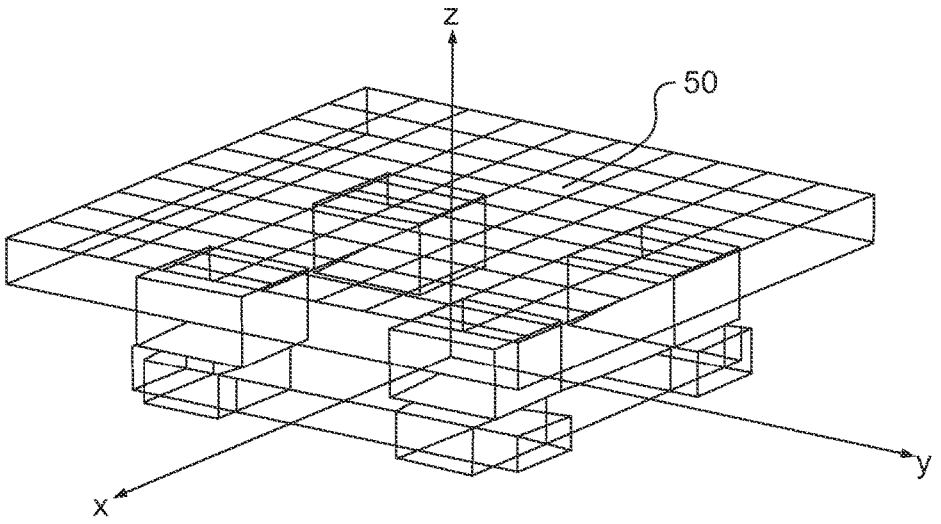

FIGS. 11*a* and 11*b* show two perspective views of two examples of a radiating element comprising a compact splitter according to any embodiment of the invention. The radiating element is made up of an array of four identical elementary radiating sources 31, 32, 33, 34 intended to be fed in-phase by two orthogonal polarizations delivered by the radiating aperture of each of the four asymmetric OMTs 10 of the splitter to which each radiating source is coupled. Each elementary radiating source may, for example, be made up of a compact horn or a stack of Fabry-Perot cavities.

Figure 12A:
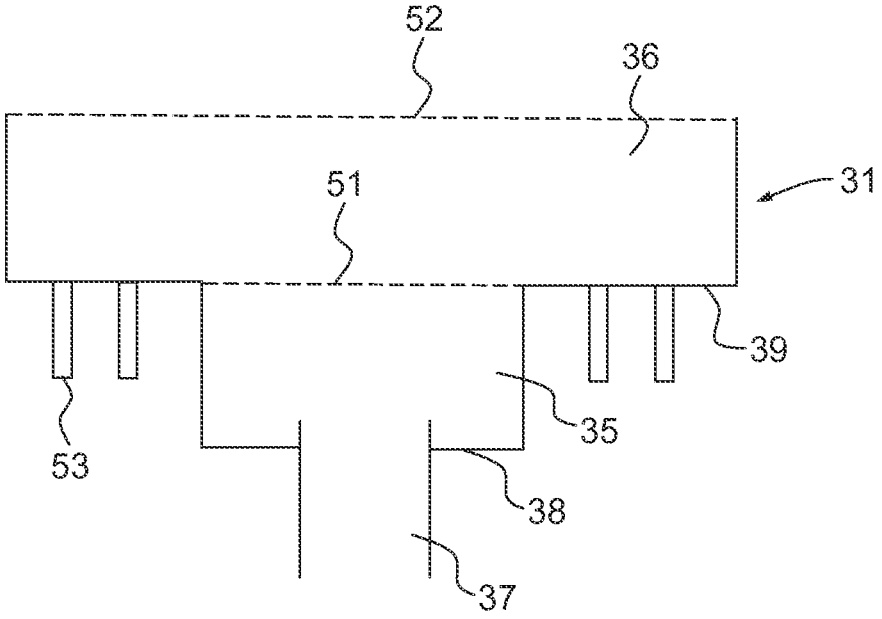
FIGS. 12*a* and 12*b* show respectively a cross-section view and a top view of an example of a radiating source made up of stacked Fabry-Perot cavities, according to the invention.
Figure 12B:
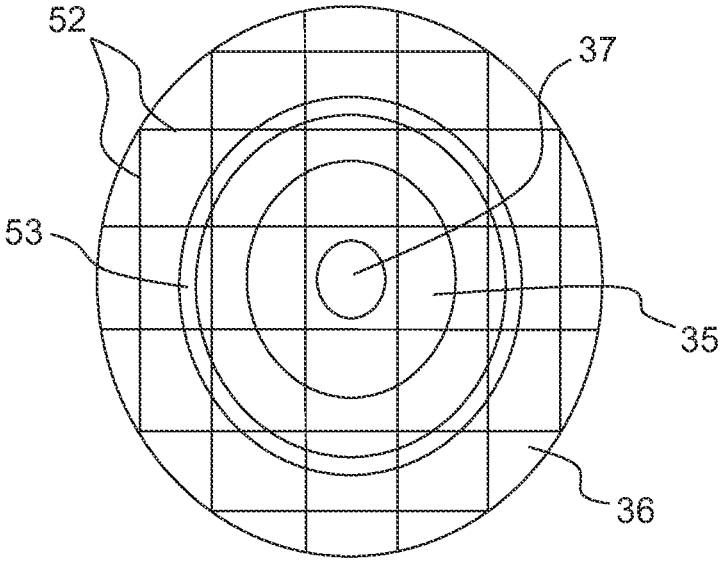

A schematic example, in cross section and in top view, of an elementary radiating source made up of stacked Fabry-Perot cavities is shown in FIGS. 12*a* and 12*b*. The elementary radiating source 31 comprises two stacked concentric resonant cavities 35, 36, each cavity being delimited by a metal lower wall making up a ground plane and by metal lateral walls, the upper cavity 36 having greater dimensions than the lower cavity 35. The lower cavity 35 comprises a feed input port 37 intended to be coupled to excitation means operating in bipolarization. The input port 37 may, for example, be a feed waveguide or an input aperture opening out into the lower cavity, for example across the ground plane 38 of the lower cavity 35. The cross section of each cavity may be circular, square, hexagonal or any other shape. However, in order to be compatible with an array formation in a square mesh, the cross section of each cavity is preferably chosen as square-shaped. Each resonant cavity 35, 36 may comprise a respective hood 51, 52 forming an upper wall, the hood being able, for example, to be made up of a metal grid forming a partially reflecting surface and increasing the excitation of the resonant cavities. For a bipolarization operation, the metal grid must be two-dimensional. Concentric metal corrugations 53, for example cylindrical in shape, can be disposed below the ground plane 39 of the upper cavity in order to control and limit the excitation of the upper modes in this cavity.

According to the invention, as shown in FIG. 11*a*, the input access port 37 of the lower resonant cavity of each elementary radiating source is coupled to the radiating aperture of an asymmetric OMT 10. In order to improve the distribution of the electric field over the radiating aperture obtained with the four radiating sources in an array, as shown in the alternative embodiment in FIG. 11 *b*, it is possible to combine the four upper resonant cavities of the four radiating sources in an array and remove the metal internal walls of the upper resonant cavities. The four upper resonant cavities of the four radiating sources comprising Fabry-Perot cavities are then replaced with a single upper resonant cavity 50 common to the four radiating sources in an array and stacked on the four lower resonant cavities. The radiating element thus obtained is very compact, in waveguide technology, and comprises a wide radiating aperture between 2.5λ and 4λ in size, with high surface efficiency and low losses, and compatible with power applications. Furthermore, in the case where the power splitter has a perfectly symmetrical structure, as described in the sixth embodiment of the invention, the array of radiating sources may comprise a fifth central elementary radiating source, which again improves the surface efficiency of the radiating aperture obtained.

Figure 13:
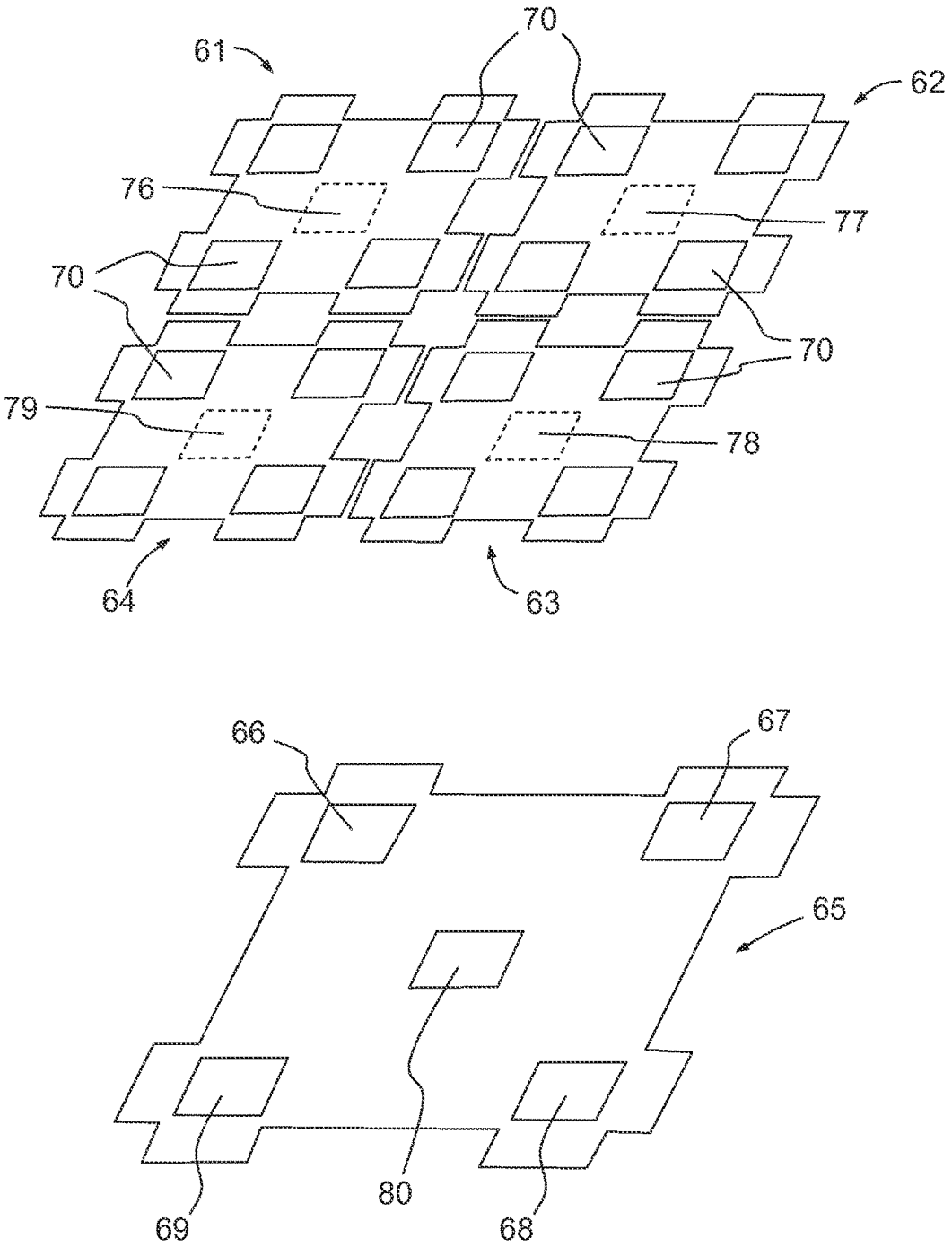
FIG. 13 shows an exploded schematic view of an example of an array of a plurality of power splitters, according to the invention.

As shown in the example in FIG. 13, in order to obtain a larger radiating aperture, it is possible to couple a plurality of power splitters in an array in order to feed a greater number of radiating sources. Two tiers of power splitters are thus shown in the example in FIG. 13. The upper level comprises four identical power splitters 61, 62, 63, 64 fed in-phase and positioned side-by-side, for example according to a square or rectangular mesh, and the lower level comprises a fifth power splitter 65 which feeds in-phase the four splitters of the upper level. The fifth power splitter 65 of the lower level comprises four asymmetric OMTs 10 positioned on the four corners of a square or rectangular mesh and coupled in a first array. The four OMTs 10 are fed in-phase by a feed port disposed in a central area 80 of the splitter 65 and intended to be connected to a feed source, the central area 80 corresponding to the overlap area 20 of the transverse branches of the two distributors of the power splitter 65. The radiating apertures 66, 67, 68, 69 of the four OMTs 10 make up four in-phase feed accesses coupled respectively to the four central accesses 76, 77, 78, 79 of the four splitters of the upper level. For this purpose, the different lateral and transverse waveguides of the fifth power splitter 65 of the lower level have lengths adapted to the distances separating two feed accesses of two power splitters of the upper level. Each power splitter of the upper level comprises four asymmetric OMTs 10 coupled in an array and fed in-phase by their central feed access 76, 77, 78, 79. The feed accesses of the splitters of the upper level being fed in-phase by the four OMTs 10 of the lower level, all the radiating apertures 70 of the OMTs 10 of the upper level are in-phase. Radiating sources, for example, radiating horns or Fabry-Perot cavities, can be coupled to each of the radiating apertures of all the OMTs 10 of the upper level in order to be fed in-phase by the power splitters coupled in an array, and may thus make up a single radiating element, the radiating aperture of which has a size multiplied by four.

Although the invention has been described in connection with particular embodiments, it is obvious that it is in no way limited thereto and that it includes all the technical equivalents of the means described and also their combinations if they fall within the scope of the invention.

The invention claimed is:

1. A compact bipolarization planar power splitter comprising:

at least four transducers to be coupled in-phase to a dual orthogonal polarization feed source and two power distributors respectively dedicated to each polarization of the dual orthogonal polarization source, the at least four transducers being connected in an array via the two power distributors, the two power distributors being mounted parallel to a plane (XY) and oriented perpendicularly in relation to one another, wherein each transducer is an asymmetric orthomode transducer (OMT) having two access ports located in the plane XY and oriented orthogonally to one another and a radiating aperture opening out perpendicularly to the plane XY, each power distributor having at least two lateral branches disposed parallel to one another, a transverse branch coupled perpendicularly to the two lateral branches and four ends of the lateral branches coupled respectively in the plane XY to the respective access ports of the four asymmetric OMTs, each lateral and transverse branch including metal waveguides, the transverse branch of each power distributor being coupled to a feed port to be connected to the feed source, wherein each waveguide of the splitter includes a rectangular section delimited by four peripheral walls opposed in pairs of different widths, and wherein the waveguides of the transverse branches and of the lateral branches are mounted flat on one of their respective wider peripheral walls parallel to the plane XY.

2. The compact bipolarization planar power splitter as claimed in claim 1, wherein each feed port includes a coupling slot disposed in a wall of the waveguides of the transverse branches of the two power distributors.

3. The compact bipolarization planar power splitter as claimed in claim 1, wherein each feed port is an access port of a fifth symmetric or asymmetric OMT disposed in an overlap area of the transverse branches of the compact bipolarization planar power splitter.

4. The compact bipolarization planar power splitter as claimed in claim 1, wherein the two power distributors are disposed parallel to the plane XY and wherein their respective transverse branches intersect in an overlap area and are coupled to one another by a T-coupler.

5. The compact bipolarization planar power splitter as claimed in claim 1, wherein the two power distributors are disposed parallel to the plane XY and wherein their respective transverse branches are superimposed on one another in an overlap area and are coupled to one another by a T-coupler in a plane E.

6. The compact bipolarization planar power splitter as claimed in claim 5, wherein the waveguides of the two transverse branches have a reduced thickness P in the overlap area.

7. The compact bipolarization planar power splitter as claimed in claim 5, wherein the four ends of the two lateral branches of the two distributors are curved and folded over the upper wall of the corresponding lateral guides and are coupled respectively to the access ports of the four asymmetric OMTs by the outside of the compact bipolarization planar power splitter, the two distributors being superimposed one above the other and oriented perpendicularly in relation to one another.

8. The compact bipolarization planar power splitter as claimed in claim 1, wherein the two lateral branches and the four transverse branches of the two power distributors are mounted on two different, respectively lower and upper, planes parallel to the plane XY, and are coupled to one another by T-couplers in the plane E via coupling slots disposed in an upper wall of the waveguides of the transverse branches and corresponding coupling slots disposed in a lower wall of the waveguides of the lateral branches.

9. The compact bipolarization planar power splitter as claimed in claim 8, wherein the waveguide of each transverse branch is made up of two waveguide sections located on either side of a central aperture and offset linearly in relation to one another in a direction perpendicular to the corresponding transverse branch, and wherein the coupling slots disposed in the upper wall of the waveguide of each transverse branch are aligned and disposed on two opposite edges of said upper wall, the two transverse branches having a rotational symmetry around a central axis of the compact bipolarization planar power splitter.

10. An array of a plurality of compact bipolarization planar power splitters as claimed in claim 1, comprising an upper level including four identical power splitters coupled in an array, and a lower level including a fifth power splitter, the fifth power splitter of the lower level comprising a feed port disposed in a central area for feeding in-phase the four power splitters of the upper level.

11. A compact radiating element, comprising an array of a plurality of compact bipolarization planar power splitters as claimed in claim 10 and at least 16 radiating sources coupled to the splitter array.

12. A compact radiating element, comprising a compact bipolarization planar power splitter as claimed in claim 1, and at least four elementary radiating sources connected in an array by the power splitter, each elementary radiating source having an access port coupled to the radiating aperture of the respective asymmetric OMT of the compact bipolarization planar power splitter.

13. The compact radiating element as claimed in claim 12, comprising five elementary radiating sources connected in an array by the compact bipolarization planar power splitter, the fifth elementary radiating source being disposed in an aperture disposed in an upper wall of the waveguides, in an elongation of the feed ports of the compact bipolarization planar power splitter, and being configured to be connected directly to the feed source of the compact bipolarization planar power splitter.

14. The compact radiating element as claimed in claim 12, wherein each elementary radiating source comprises two, respectively lower and upper, concentric and stacked Fabry-Perot cavities.

15. The compact radiating element as claimed in claim 14, wherein said each, respectively lower and upper, Fabry-Perot cavity has a square-shaped cross section.

16. The compact radiating element as claimed in claim 14, wherein the upper cavities of all the elementary radiating sources connected in an array by the compact bipolarization planar power splitter are combined to form a single cavity common to all the elementary radiating sources.

17. A planar antenna, comprising at least one compact radiating element as claimed in claim 12.

18. A compact bipolarization planar power splitter comprising:

at least four transducers to be coupled in-phase to a dual orthogonal polarization feed source and two power distributors respectively dedicated to each polarization of the dual orthogonal polarization source, the at least four transducers being connected in an array via the two power distributors, the two power distributors being mounted parallel to a plane (XY) and oriented perpendicularly in relation to one another, wherein each transducer is an asymmetric orthomode transducer (OMT) having two access ports located in the plane XY and oriented orthogonally to one another and a radiating aperture opening out perpendicularly to the plane XY, each power distributor having at least two lateral branches disposed parallel to one another, a transverse branch coupled perpendicularly to the two lateral branches and four ends of the lateral branches coupled respectively in the plane XY to the respective access ports of the four asymmetric OMTs, each lateral and transverse branch including metal waveguides, the transverse branch of each power distributor being coupled to a feed port to be connected to the feed source, wherein each waveguide of the compact bipolarization planar power splitter includes a rectangular section delimited by four peripheral walls opposed in pairs of different widths, wherein the waveguides of the transverse branches are mounted on one of their narrower peripheral walls in such a way that their respective wider peripheral walls are perpendicular to the plane XY, and wherein the waveguides of the lateral branches are mounted flat with their two respective wider peripheral walls parallel to the plane XY.

19. The compact bipolarization planar power splitter as claimed in claim 18, wherein the two power distributors are disposed in a same plane H parallel to the plane XY, wherein their respective transverse branches intersect in an overlap area and are coupled to one another by a T-coupler in the plane H, and wherein the waveguides of the transverse branches are coupled to the waveguides of the lateral branches by T- couplers in the plane E.

20. The compact bipolarization planar power splitter as claimed in claim 19, wherein, in the T-couplers in the plane E, the waveguides of the transverse branches are embedded in the corresponding waveguides of the lateral branches.

21. The compact bipolarization planar power splitter as claimed in claim 18, wherein the two power distributors include transverse branches that are independent of each other and are superimposed one above the other, one of the narrower walls of the waveguide of each said transverse branch comprising a respective notch, the two respective notches of the two distributors abutting one another.

22. The compact bipolarization planar power splitter as claimed in claims 18, wherein each feed port includes a coupling slot disposed in a wall of the waveguides of the transverse branches of the two power distributors.

23. The compact bipolarization planar power splitter as claimed in claims 18, wherein each feed port is an access port of a fifth symmetric or asymmetric OMT disposed in an overlap area of the transverse branches of the compact bipolarization planar power splitter.

24. An array of a plurality of compact bipolarization planar power splitters as claimed in claims 18, comprising an upper level including four identical power splitters coupled in an array, and a lower level including a fifth power splitter, the fifth power splitter of the lower level comprising a feed port disposed in a central area for feeding in-phase the four power splitters of the upper level.

25. A compact radiating element, comprising a compact bipolarization planar power splitter as claimed in claims 18, and at least four elementary radiating sources connected in an array by the power splitter, each elementary radiating source having an access port coupled to the radiating aperture of the respective asymmetric OMT of the compact bipolarization planar power splitter.

26. A compact bipolarization planar power splitter comprising:

at least four transducers to be coupled in-phase to a dual orthogonal polarization feed source and two power distributors respectively dedicated to each polarization of the dual orthogonal polarization source, the at least four transducers being connected in an array via the two power distributors, the two power distributors being mounted parallel to a plane (XY) and oriented perpendicularly in relation to one another, wherein each transducer is an asymmetric orthomode transducer (OMT) having two access ports located in the plane XY and oriented orthogonally to one another and a radiating aperture opening out perpendicularly to the plane XY, each power distributor having at least two lateral branches disposed parallel to one another, a transverse branch coupled perpendicularly to the two lateral branches and four ends of the lateral branches coupled respectively in the plane XY to the respective access ports of the four asymmetric OMTs, each lateral and transverse branch including metal waveguides, the transverse branch of each power distributor being coupled to a feed port to be connected to the feed source, wherein the two power distributors are disposed parallel to the plane XY and wherein their transverse branches intersect in an overlap area and are coupled to one another by a T-coupler, wherein each waveguide of the compact bipolarization planar power splitter includes a rectangular section delimited by four peripheral walls opposed in pairs of different widths, and wherein the waveguides of the transverse branches and the waveguides of the lateral branches are mounted on one of their respective narrower peripheral walls in such a way that their respective wider peripheral walls are perpendicular to the plane XY.

27. The compact bipolarization planar power splitter as claimed in claims 26, wherein each feed port includes a coupling slot disposed in a wall of the waveguides of the transverse branches of the two power distributors.

28. The compact bipolarization planar power splitter as claimed in claims 26, wherein each feed port is an access port of a fifth symmetric or asymmetric OMT disposed in an overlap area of the transverse branches of the compact bipolarization planar power splitter.

29. An array of a plurality of compact bipolarization planar power splitters as claimed in claims 26, comprising an upper level including four identical power splitters coupled in an array, and a lower level including a fifth power splitter, the fifth power splitter of the lower level comprising a feed port disposed in a central area for feeding in-phase the four power splitters of the upper level.

30. A compact radiating element, comprising a compact bipolarization planar power splitter as claimed in claims 26, and at least four elementary radiating sources connected in an array by the power splitter, each elementary radiating source having an access port coupled to the radiating aperture of the respective asymmetric OMT of the compact bipolarization planar power splitter.

31. The compact bipolarization planar power splitter comprising:

at least four transducers to be coupled in-phase to a dual orthogonal polarization feed source and two power distributors respectively dedicated to each polarization of the dual orthogonal polarization source, the at least four transducers being connected in an array via the two power distributors, the two power distributors being mounted parallel to a plane (XY) and oriented perpendicularly in relation to one another, wherein each transducer is an asymmetric orthomode transducer (OMT) having two access ports located in the plane XY and oriented orthogonally to one another and a radiating aperture opening out perpendicularly to the plane XY, each power distributor having at least two lateral branches disposed parallel to one another, a transverse branch coupled perpendicularly to the two lateral branches and four ends of the lateral branches coupled respectively in the plane XY to the respective access ports of the four asymmetric OMTs, each lateral and transverse branch including metal waveguides, the transverse branch of each power distributor being coupled to a feed port to be connected to the feed source, wherein the two transverse branches of the two power distributors are respectively mounted in two different planes parallel to the plane XY and located on either side of the plane XY in which the lateral branches of the two power distributors are disposed, each transverse branch being coupled to the lateral branches of the corresponding distributor by a T-coupler in the plane E.

32. An array of a plurality of compact bipolarization planar power splitters as claimed in claims 31, comprising an upper level including four identical power splitters coupled in an array, and a lower level including a fifth power splitter, the fifth power splitter of the lower level comprising a feed port disposed in a central area for feeding in-phase the four power splitters of the upper level.

33. A compact radiating element, comprising a compact bipolarization planar power splitter as claimed in claims 31, and at least four elementary radiating sources connected in an array by the power splitter, each elementary radiating source having an access port coupled to the radiating aperture of the respective asymmetric OMT of the compact bipolarization planar power splitter.

* * * * *